US010210809B2

(12) United States Patent
Miki

(10) Patent No.: US 10,210,809 B2
(45) Date of Patent: Feb. 19, 2019

(54) DISPLAY DEVICE

(71) Applicant: JOLED INC., Tokyo (JP)

(72) Inventor: Takashi Miki, Hyogo (JP)

(73) Assignee: JOLED INC., Tokyo (JP)

( * ) Notice: Subject to any disclaimer, the term of this patent is extended or adjusted under 35 U.S.C. 154(b) by 84 days.

(21) Appl. No.: 15/518,790

(22) PCT Filed: Sep. 29, 2015

(86) PCT No.: PCT/JP2015/004936
§ 371 (c)(1),
(2) Date: Apr. 13, 2017

(87) PCT Pub. No.: WO2016/059756
PCT Pub. Date: Apr. 21, 2016

(65) Prior Publication Data

US 2017/0236470 A1 Aug. 17, 2017

(30) Foreign Application Priority Data

Oct. 16, 2014 (JP) ..... 2014-211843

(51) Int. Cl.
*G09G 3/3233* (2016.01)
*G09G 3/3258* (2016.01)

(52) U.S. Cl.
CPC ..... *G09G 3/3258* (2013.01); *G09G 3/3233* (2013.01); *G09G 2300/0809* (2013.01);
(Continued)

(58) Field of Classification Search
CPC ..... G09G 3/3258; G09G 3/3233; G09G 2300/0809; G09G 2300/0819; G09G 2300/0842; G09G 2300/0861; G09G 2300/0866; G09G 2310/0245; G09G 2310/0262; G09G 2310/08; G09G 2320/0626; G09G 2330/02; G09G 2330/027; G09G 2330/07; H05B 33/08
See application file for complete search history.

(56) References Cited

U.S. PATENT DOCUMENTS

2013/0241965 A1 9/2013 Koyama
2014/0092144 A1 4/2014 Kim et al.
2016/0267845 A1 9/2016 Tsuge

FOREIGN PATENT DOCUMENTS

JP 2003-216100 7/2003
JP 2013-218311 10/2013
(Continued)

OTHER PUBLICATIONS

International Search Report issued in International Patent Application No. PCT/JP2015/004936, dated Dec. 22, 2015.

*Primary Examiner* — Julie Anne Watko
(74) *Attorney, Agent, or Firm* — Greenblum & Bernstein, P.L.C.

(57) ABSTRACT

A display device according to the present disclosure is a display device including a plurality of pixels arranged in a matrix, each of the plurality of pixels including: an EL element that emits light according to the amount of current supplied; a driving transistor that controls light emission of the EL element; and switches connected to a gate of the driving transistor. The display device includes an electric charge drawing unit configured to draw electric charges in the gate of the transistor provided in each of the plurality of pixels when power supply to the display device is stopped.

7 Claims, 19 Drawing Sheets

(52) U.S. Cl.
CPC ..... *G09G 2300/0819* (2013.01); *G09G 2300/0842* (2013.01); *G09G 2300/0861* (2013.01); *G09G 2300/0866* (2013.01); *G09G 2310/0245* (2013.01); *G09G 2310/0262* (2013.01); *G09G 2310/08* (2013.01); *G09G 2320/0626* (2013.01); *G09G 2330/02* (2013.01); *G09G 2330/027* (2013.01); *G09G 2330/04* (2013.01)

(56) References Cited

FOREIGN PATENT DOCUMENTS

| | | |
|---|---|---|
| JP | 2014-071450 | 4/2014 |
| WO | 2015/063988 | 5/2015 |

DISPLAY DEVICE

TECHNICAL FIELD

The present disclosure relates to a display device including a plurality of pixels arranged in a matrix.

BACKGROUND ART

In an active matrix display device that utilizes organic electroluminescence (EL) such as an organic EL display, a thin film transistor (TFT) is used as a driving transistor.

With a display device that includes, as the thin film transistor, an oxide thin film transistor in which a channel is formed in an oxide semiconductor layer, a problem such as deterioration in display quality may occur as a result of electric charges being continuously held in a particular node in a pixel when a supply of a power supply voltage to the display device is stopped.

To address this, a configuration is disclosed that solves the problem by providing a transistor that electrically connects the gate and source of a driving transistor when a supply of a power supply voltage to the display device is stopped (for example, Patent Literature (PTL) 1).

CITATION LIST

Patent Literature

[PTL 1] Japanese Unexamined Patent Application Publication No, 2013-218311

SUMMARY OF INVENTION

Technical Problem

However, with the configuration described above, the electric charges held in the gate of the driving transistor may not be sufficiently removed when the supply of the power supply voltage to the display device is stopped. Accordingly, a load is applied to the driving transistor due to the electric charges left in the gate of the driving transistor, which may cause a degradation in reliability and characteristics. Such a degradation of the transistor in a pixel as described above is problematic in that it affects the long term reliability of the display device.

The present disclosure has been made in view of the problem described above, and the present disclosure provides a display device in which it is possible to suppress the degradation of transistors provided in pixels while power supply to the display device is stopped.

Solution to Problem

In view of the problem described above, a display device according to the present disclosure is a display device including: a plurality of pixels arranged in a matrix, each of the plurality of pixels including: a light emitting element that emits light according to an amount of current supplied; a transistor that controls light emission of the light emitting element; and a first switch connected to a gate of the transistor; and an electric charge drawing unit configured to draw electric charges in the gate of the transistor included in each of the plurality of pixels when power supply to the display device is stopped.

Advantageous Effects of Invention

According to the present disclosure, it is possible to suppress the degradation of transistors provided in pixels while power supply to the display device is stopped.

DESCRIPTION OF EMBODIMENTS

Figure 1:
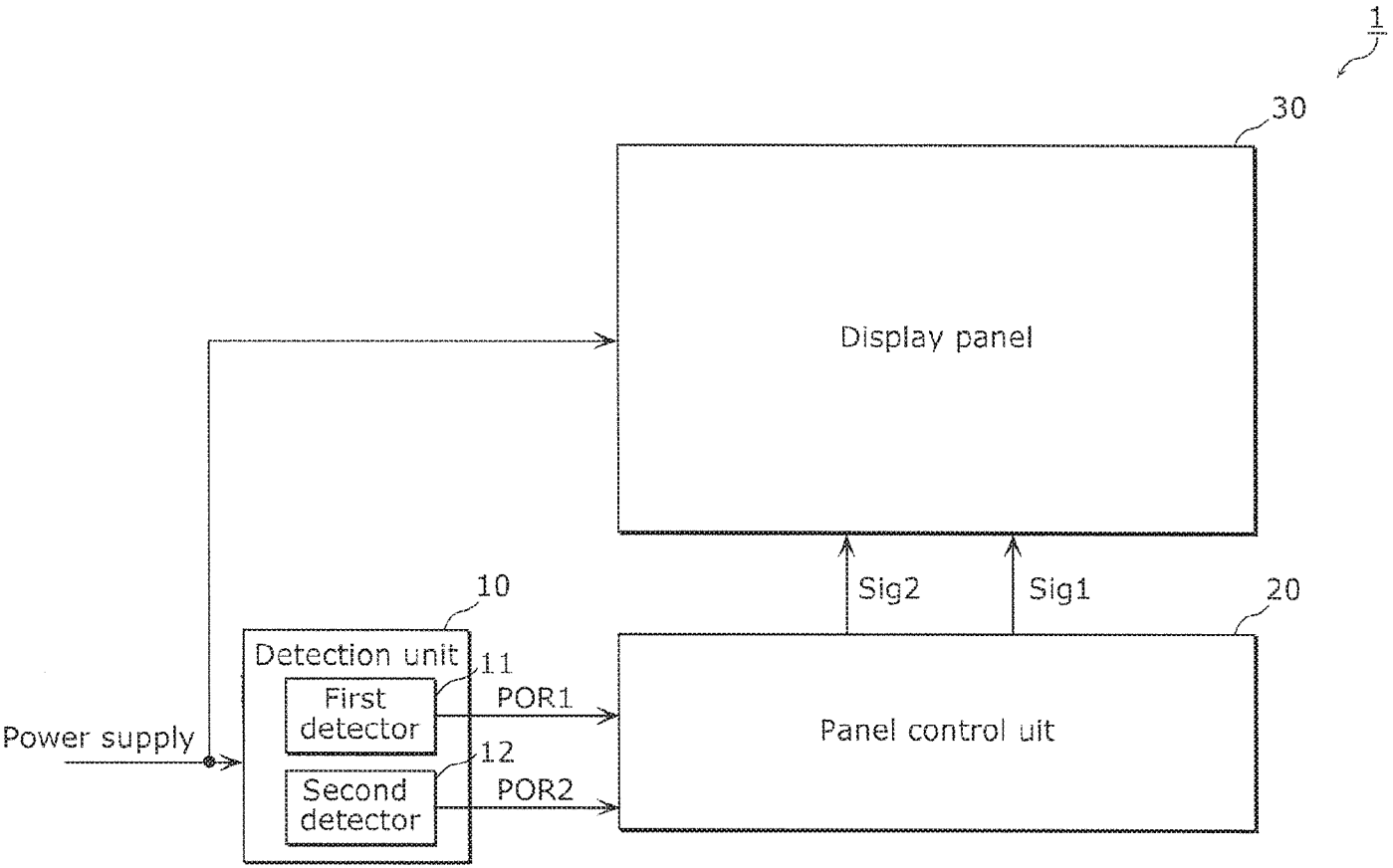
FIG. 1 is a block diagram showing an example of a configuration of a display device according to Embodiment 1.

An aspect of a display device according to the present disclosure is a display device including: a plurality of pixels arranged in a matrix, each of the plurality of pixels including: a light emitting element that emits light according to an amount of current supplied; a transistor that controls light emission of the light emitting element; and a first switch connected to a gate of the transistor; and an electric charge drawing unit configured to draw electric charges in the gate of the transistor included in each of the plurality of pixels when power supply to the display device is stopped.

As described above, the display device draws the electric charges held in the gates of the transistors when the power supply to the display device is stopped. Accordingly, it is possible to suppress the load applied to the transistors while the power supply to the display device is stopped. Thus, the display device according to the present aspect can suppress the degradation of the transistor provided in each pixel while the power supply to the display device is stopped. That is, long term reliability of the display device can be attained.

Also, the electric charge drawing unit may include a detection unit configured to detect the stop of the power supply by detecting a reduction in a power supply voltage supplied from outside the display device.

With this configuration, the stop of power supply can be detected before the power supply voltage of the display device reaches a low level voltage (for example, 0 [V]). Accordingly, even when the internal voltage is necessary for the electric charge drawing unit to draw electric charges, it is possible to draw the electric charges held in the gate of the transistor.

Also, the electric charge drawing unit may draw the electric charges by placing the first switch in a conducting state when the stop of power supply is detected by the detection unit.

As described above, according to the present aspect, electric charges are drawn by placing the first switch provided in each pixel in a conducting state. Accordingly, it is unnecessary to provide an additional configuration for drawing electric charges, and thus the pixel configuration can be simplified.

Also, the first switch may switch an electrical connection between the gate of the transistor and a first wiring line between a conducting state and a non-conducting state, and the electric charge drawing unit may be configured to, when the stop of power supply is detected by the detection unit, place the first switch in a conducting state after a voltage of the first wiring line reaches a predetermined voltage.

Also, the display device may further include a second switch connected to the gate of the transistor, and the electric charge drawing unit may be configured to draw the electric charges by placing the second switch in a conducting state when the stop of power supply is detected by the detection unit.

With this configuration, it is possible to draw the electric charges held in the gate of the transistor with simple control.

Also, the first switch may switch an electrical connection between the gate of the transistor and a first wiring line between a conducting state and a non-conducting state, the second switch may switch an electrical connection between the gate of the transistor and a second wiring line different from the first wiring line between a conducting state and a non-conducting state, and a predetermined voltage may be applied to the second wiring line.

With this configuration, it is unnecessary to switch the voltage of the second wiring line, and it is therefore possible to draw the electric charges held in the gate of the transistor with simpler control.

Also, the first switch and the second switch may switch an electrical connection between the gate of the transistor and a first wiring line between a conducting state and a non-conducting state, and the electric charge drawing unit may be configured to, when the stop of power supply is detected by the detection unit, place the second switch in a conducting state after a voltage of the first wiring line reaches a predetermined voltage.

Also, the first wiring line may be a power supply line that supplies a power supply voltage for controlling the light emission of the light emitting element to the plurality of pixels or a signal line that supplies a signal voltage corresponding to a brightness level of the light emitting element to the plurality of pixels.

As described above, according to the present aspect, the voltage of the first wiring line to which the power supply voltage or the signal voltage is supplied during a normal operation in which power is supplied to the display device is changed to a predetermined voltage when the power supply is stopped (power supply stop operation). That is, in the present aspect, the voltage of the first wiring line is switched between when the normal operation is performed and the power supply stop operation is performed, and it is thereby possible to draw the electric charges via the first wiring line. That is, it is unnecessary to provide an additional configuration for drawing the electric charges, and thus the configuration can be simplified.

Also, the electric charge drawing unit may include a resistor element having one end connected to the gate of the transistor, and a predetermined voltage may be applied to the other end of the resistor element when the power supply is stopped.

This configuration eliminates the need to control the switches to be in a conducting state or a non-conducting state, as compared to the configuration in which the electric charges are drawn by placing the switches in a conducting state. Accordingly, it is possible to draw the electric charges held in the gate of the transistor when the power supply to the display device is stopped, with a simple configuration and simple control.

Also, the predetermined voltage may be a voltage that reduces an electrical stress applied to the transistor.

With this configuration, when an equilibrium state is reached as a result of electric charges being drawn from the gate of the transistor, or in other words, when the drawing of electric charges has been completed, the voltage of the gate reaches a voltage that reduces an electrical stress applied to the transistor. Accordingly, the degradation of the reliability and the degradation of the characteristics of the transistor can be further suppressed.

Also, the transistor may be a driving transistor that supplies an electric current to the light emitting element.

Hereinafter, aspects of a display device according to the present disclosure will be described specifically with reference to the drawings. However, an excessively detailed description may be omitted. For example, a detailed description of already well-known matters and an overlapping description of substantially the same structural elements may be omitted. This is to avoid the following description from being unnecessarily lengthy and to facilitate the understanding of a person having ordinary skill in the art.

Note that the present inventors provide the accompanying drawings and the following description for a person having ordinary skill in the art to sufficiently understand the present disclosure, and thus the accompanying drawings and the following description are not intended to limit the subject matter defined in the claims. For example, the numerical values, shapes, materials, structural elements, the arrangement and connection of the structural elements, and the like shown in the following embodiments are merely examples, and therefore are not intended to limit the scope of the present disclosure. Also, among the structural elements described in the following embodiments, structural elements not recited in any one of the independent claims are described as arbitrary structural elements. Note also that the diagrams are schematic representations, and thus are not necessarily true to scale.

(Embodiment 1)

Hereinafter, Embodiment 1 according to the present disclosure will be described.

[1-1. Configuration]

[1-1-1. Display Device]

First, a configuration of a display device according to the present embodiment will be described with reference to FIGS. 1 and 2.

FIG. 1 is a block diagram showing an example of a configuration of a display device according to Embodiment 1. FIG. 2 is a block diagram showing an example of a configuration of a display panel shown in FIG. 1.

As shown in FIG. 1, the display device 1 includes a detection unit 10, a panel control unit 20, and a display panel 30.

The detection unit 10 detects a stop of power supply to the display device 1. To be specific, the detection unit 10 detects a stop of power supply by detecting a reduction in a power supply voltage supplied from outside the display device 1.

The stop of power supply encompasses, for example, a reduction in the power supply voltage caused by a power button of a remote controller being pressed by the user, by a power button on the main body of the display device 1 being pressed, by the arrival of the off time set in an off timer by the user, by the elapse of a set time of a timer that measures the length of time during which no operation is performed by the user, by AC power supply voltage dropping in case of a blackout, and the like.

To be specific, the detection unit 10 includes a first detector 11 that detects that the power supply voltage has reached a first threshold voltage or less and outputs a detection signal POR1 in the timing at which the detection was made and a second detector 12 that detects that the power supply voltage has reached a second threshold voltage or less, the second threshold voltage being smaller than the first threshold voltage, and outputs a detection signal POR2 in the timing at which the detection was made. That is, the detection unit 10 outputs the detection signal POR1 when the power supply voltage decreases and reaches the first threshold voltage due to the power supply being stopped, and outputs the detection signal POR2 when the power supply voltage continuously decreases and reaches the second threshold voltage.

The first threshold voltage is a voltage that is smaller than a high level voltage VDD that is the maximum power supply voltage and is larger than a low level voltage VSS that is the minimum power supply voltage. The second threshold voltage is a voltage that is smaller than the first threshold voltage and is larger than the low level voltage VSS.

If the detection unit 10 detects a stop of power supply, the panel control unit 20 outputs, to the display panel 30, panel control signals Sig1 and Sig2 for causing a power supply stop operation to be performed. To be specific, the panel control unit 20 outputs the panel control signal Sig1 when the detection signal POR1 is output from the first detector 11, and outputs the panel control signal Sig2 when the detection signal POR2 is output from the second detector 12.

The display panel 30 is, for example, an organic EL panel that performs operation by using power supplied from outside the display device 1. To be specific, as shown in FIG. 2, the display panel 30 includes a power supply unit 31, a data line driving circuit 32, a scan line driving circuit 33, and a pixel array 34.

The pixel array 34 includes, at least, N (for example, N=1080) Scan lines that are scanning lines disposed parallel to each other and M Data lines that are source signal lines disposed perpendicular to the Scan lines. Furthermore, the pixel array 34 includes pixels, each disposed at each intersection of a Scan line and a Data line, the pixel including a thin film transistor and an EL (electroluminescent) element. The pixel configuration will be described later in detail.

The power supply unit 31 supplies power to the data line driving circuit 32, the scan line driving circuit 33, and the pixel array 34, and also supplies various types of power supply voltages to the pixel array 34. As used herein, the various types of power supply voltages include VINT, VREF, VTFT, VEL as shown in FIG. 2, and they are supplied to each pixel via an initialization power supply line, a reference voltage power supply line, an EL anode power supply line, and an EL cathode power supply line.

The data line driving circuit 32 drives the Data lines of the pixel array 34. To be more specific, the data line driving circuit 32 outputs a signal voltage DATA to the Data lines at a predetermined timing.

The scan line driving circuit 33 drives the Scan lines and the like of the pixel array 34. To be more specific, the scan line driving circuit 33 controls each switch provided in a pixel to be in a conducting state or a non-conducting state by outputting a scan signal, a REF signal, an enable signal, and an init signal to a Scan line, a Ref line, an Enable line, and an Init line provided in the pixel, which will be described later, at a predetermined timing.

Here, when the panel control signals Sig1 and Sig2 are output from the panel control unit 20, the power supply unit 31, the data line driving circuit 32 and the scan line driving circuit 33 cause various types of power supply voltages, the voltages of various types of signals, and signal voltages that are supplied to the pixel array 34 (hereinafter also referred to as "supply voltages supplied to the pixel array 34") to decrease in the following manner.

To be specific, when the panel control signal Sig1 is output from the panel control unit 20, the power supply unit 31, the data line driving circuit 32 and the scan line driving circuit 33 cause, among the supply voltages supplied to the pixel array 34, various types of power supply voltages, the voltages of various types of signals, and signal voltages that are associated with the panel control signal Sig1 (hereinafter also referred to as "voltages corresponding to the panel control signal Sig1") to decrease. When the panel control signal Sig2 is output from the panel control unit 20, the power supply unit 31, the data line driving circuit 32 and the scan line driving circuit 33 cause, among the supply voltages supplied to the pixel array 34, various types of power supply voltages, the voltages of various types of signals, and signal voltages that are associated with the panel control signal Sig2 (hereinafter also referred to as "voltages corresponding to the panel control signal Sig2") to decrease.

For example, in the present embodiment, the voltages corresponding to the panel control signal Sig1 are VINI, VREF, VTFT, VEL, and DATA. The voltages corresponding to the panel control signal Sig2 are a scan signal SCAN, a REF signal REF, an enable signal ENB, and an init signal INI.

Here, the supply voltages supplied to the pixel array 34 may be pulsed waveforms. In this case, the voltages corresponding to the panel control signal Sig1 and the voltages corresponding to the panel control signal Sig2 correspond to high level voltages of the pulsed waveforms.

In the display device 1 configured as described above, when the power supply to the display device 1 is stopped, the electric charges held in the gate of the driving transistor provided in each of a plurality of pixels can be drawn. In the present embodiment, the drawing of electric charges is implemented by the detection unit 10, the panel control unit 20, the power supply unit 31, the data line driving circuit 32, and the scan line driving circuit 33. That is, in the present embodiment, an electric charge drawing unit that draws the electric charges held in the gate of the driving transistor provided in each of a plurality of pixels when the power supply to the display device 1 is stopped corresponds to the detection unit 10, the panel control unit 20, the power supply unit 31, the data line driving circuit 32, and the scan line driving circuit 33.

The mechanism for drawing the electric charges when the power supply is stopped will be described later.

Although not illustrated in the diagrams, the display device 1 may include, for example, a CPU (Central Processing Unit), a storage medium such as a ROM (Read Only Memory) in which a control program is stored, a work memory such as a RAM (Random Access Memory), and a communication circuit.

[1-1-2. Pixel]

Figure 3:
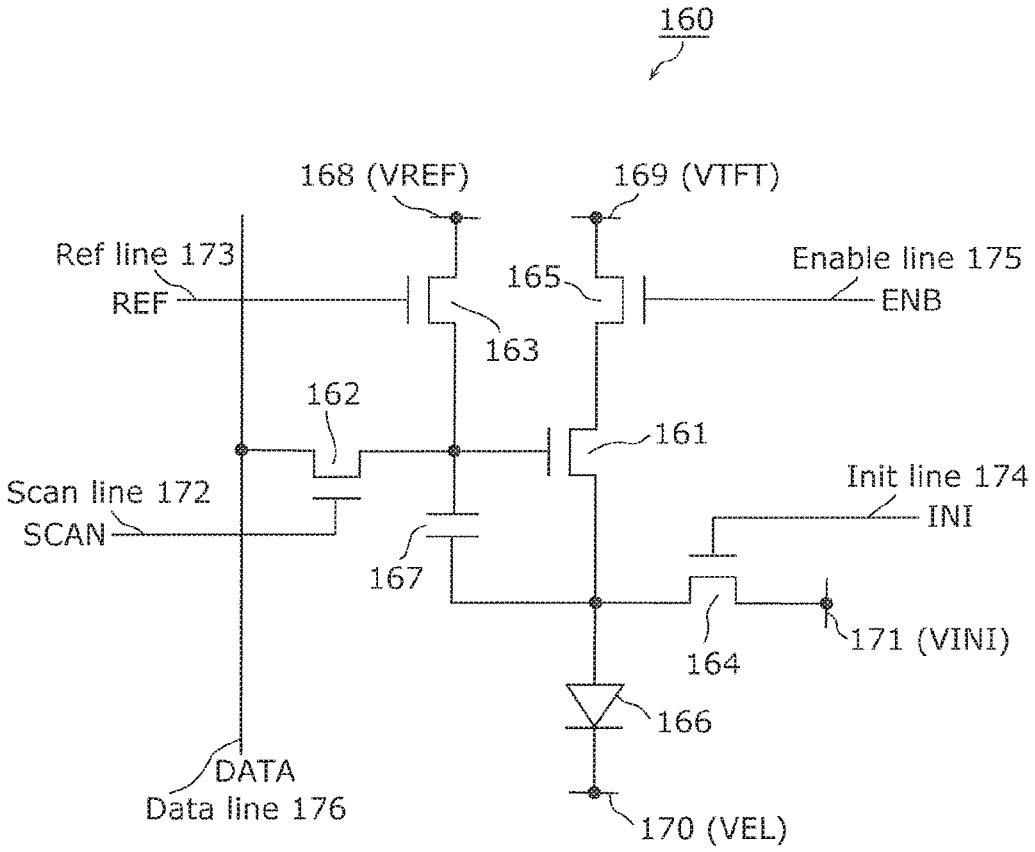
FIG. 3 is a circuit diagram showing a configuration of a pixel according to Embodiment 1.

Next, an example of a configuration of a pixel disposed in the pixel array 34 will be described with reference to FIG. 3. FIG. 3 is a circuit diagram showing a configuration of a pixel according to Embodiment 1.

A pixel 160 shown in FIG. 3 is one of the pixels disposed in the display panel 30, and emits light in an amount corresponding to a data signal (signal voltage) supplied via a Data line 176. As described above, a plurality of pixels 160 are arranged in a matrix, and each of the pixels 160 includes a driving transistor 161, switches 162 to 165, an EL element 166, and a capacitor 167. Also, the pixel 160 includes a Data line 176, a reference voltage power supply line 168 (VREF), an EL anode power supply line 169 (VTFT), an EL cathode power supply line 170 (VEL), and an initialization power supply line 171 (VINI).

Here, the Data line 176 is a signal line for supplying a signal voltage DATA.

The reference voltage power supply line 168 (VREF) is a power supply line that supplies a reference voltage VREF that defines the voltage value of a first electrode of the capacitor 167. The EL anode power supply line 169 (VTFT) is a high-voltage side power supply line for determining the potential of a drain electrode in the driving transistor 161. The EL cathode power supply line 170 (VEL) is a low-voltage side power supply line that is connected to a second electrode (cathode) of the EL element 166. The initialization power supply line 171 (VINI) is a power supply line for initializing the gate-to-source voltage of the driving transistor 161, or in other words, the voltage of the capacitor 167.

The EL element 166 is an example of a light emitting element, and a plurality of EL elements 166 are arranged in a matrix configuration in the pixel array 34. The EL element 166 has a light-emitting period during which the EL element 166 emits light as a result of a drive current being passed therethrough, and a non light-emitting period during which the EL element 166 does not emit light as a result of a drive current not being passed therethrough. To be specific, the EL element 166 emits light in an amount corresponding to the amount of current supplied from the driving transistor 161. The EL element 166 is, for example, an organic EL element. In the EL element 166, its cathode is connected to the EL cathode power supply line 170, and its anode is connected to the source (source electrode) of the driving transistor 161. Here, the voltage supplied to the EL cathode power supply line 170 is represented by VEL, and may be, for example, 0[V].

The driving transistor 161 is a driving element for driving a voltage that controls the amount of current supplied to the EL element 166, and causes an electric current (drive current) to flow through the EL element 166 so as to cause the EL element 166 to emit light. To be specific, in the driving transistor 161, its gate electrode is connected to the first electrode of the capacitor 167, and its source electrode is connected to a second electrode of the capacitor 167 and the anode of the EL element 66.

When the switch 163 is switched to an off state (non-conducting state) so as not to electrically connect the reference voltage power supply line 168 and the first electrode of the capacitor 167, and a switch 165 is switched to an on state (conducting state) so as to electrically connect the EL anode power supply line 169 and the drain electrode, the driving transistor 161 causes a drive current, which is an electric current corresponding to the signal voltage to flow through the EL element 166 so as to cause the EL element 166 to emit light. Here, the voltage supplied to the EL anode power supply line 169 is represented by VTFT, and may be, for example, 20 V. With this configuration, the driving transistor 161 converts the signal voltage supplied to the gate electrode to a signal current corresponding to the signal voltage, and supplies the signal current obtained by the conversion to the EL element 166.

Also, when the switch 163 is switched to an off state (non-conducting state) so as not to electrically connect the reference voltage power supply line 168 and the first electrode of the capacitor 167, and the switch 165 is switched to an off state (non-conducting state) so as not to electrically connect the EL anode power supply line 169 and the drain electrode, the driving transistor 161 does not cause the EL element 166 to emit light by not causing the drive current to flow through the EL element 166.

The capacitor 167 stores a voltage that determines the amount of current flowing through the driving transistor 161. To be specific, the capacitor 167 is provided between the gate and the source of the driving transistor 161, and the second electrode of the capacitor 167 (the electrode on the source side of the driving transistor 161) is connected between the source of the driving transistor 161 (the EL cathode power supply line 170 side) and the anode of the EL element 166. The first electrode of the capacitor 167 (the electrode on the gate side of the driving transistor 161) is connected to the gate of the driving transistor 161. Also, the first electrode of the capacitor 167 is connected to the reference voltage power supply line 168 (VREF) via the switch 163.

The switch 162 switches the electrical connection between the Data line 176 (signal line) for supplying a signal voltage and the first electrode of the capacitor 167 between a conducting state and a non-conducting state. To be specific, the switch 162 is a switching transistor in which one terminal of the drain and the source is connected to the Data line 176, the other terminal of the drain and the source is connected to the first electrode of the capacitor 167, and the gate is connected to a Scan line 172, which is a scanning line. To rephrase it, the switch 162 has a function of writing, into the capacitor 167, a signal voltage (data signal) supplied via the Data line 176.

The switch 163 switches the electrical connection between the reference voltage power supply line 168 that supplies a reference voltage VREF and the first electrode of the capacitor 167 between a conducting state and a non-conducting state. To be specific, the switch 163 is a switching transistor in which one terminal of the drain and the source is connected to the reference voltage power supply line 168 (VREF), the other terminal of the drain and the source is connected to the first electrode of the capacitor 167, and the gate is connected to a Ref line 173. To rephrase it, the switch 163 has a function of providing the reference voltage (VREF) to the first electrode of the capacitor 167 (the gate of the driving transistor 161).

The switch 164 switches the electrical connection between the second electrode of the capacitor 167 and the initialization power supply line 171 between a conducting state and a non-conducting state. To be specific, the switch 164 is a switching transistor in which one terminal of the drain and the source is connected to the initialization power supply line 171 (VINI), the other terminal of the drain and the source is connected to the second electrode of the capacitor 167, and the gate is connected to an Init line 174. To rephrase it, the switch 164 has a function of providing an initialization voltage (VINI) to the second electrode of the capacitor 167 (the source of the driving transistor 161).

The switch 165 switches the electrical connection between the EL anode power supply line 169 and the drain electrode of the driving transistor 161 between a conducting state and a non-conducting state. To be specific, the switch 165 is a switching transistor in which one terminal of the drain and the source is connected to the EL anode power supply line 169 (VTFT), the other terminal of the drain and the source is connected to the drain electrode of the driving transistor 161, end the gate is connected to an Enable line 175.

The pixel 160 configured as described above emits light at a brightness level corresponding to the signal voltage (data signal) supplied from the data line driving circuit 32 via the Data line 176.

The following description will be given assuming that the switches 162 to 164 and the switch 165 constituting the pixel 160 are n-type TFTs, but the present embodiment is not limited thereto. The switches 162 to 164 and the switch 165 may be p-type TFTs. Alternatively, as the switches 162 to 164 and the switch 165, n-type TFTs and p-type TFTs may be used in combination. With respect to a signal line connected to the gate of a p-type TFT, the voltage level, which will be described below, may be reversed.

Also, the potential difference between the voltage VREF of the reference voltage power supply line 168 and the voltage VINI of the initialization power supply line 171 is set to a voltage larger than the maximum threshold voltage of the driving transistor 161.

Also, the voltage VREF of the reference voltage power supply line 168 and the voltage VINI of the initialization power supply line 171 are set as follows so as to prevent an electric current from flowing through the EL element 166.

Voltage VINI<Voltage VEL+(Forward current threshold voltage of EL element 166)

(Voltage VREF of reference voltage power supply line 168)<Voltage VEL+(Forward current threshold voltage of EL element 166)+(Threshold voltage of driving transistor 161)

Here, the voltage VEL is, as described above, the voltage of the EL cathode power supply line 170.

[1-2. Operation]

Next, an operation of the display device 1 according to the present embodiment configured as described above will be described with reference to FIGS. 4 to 6.

Figure 4:
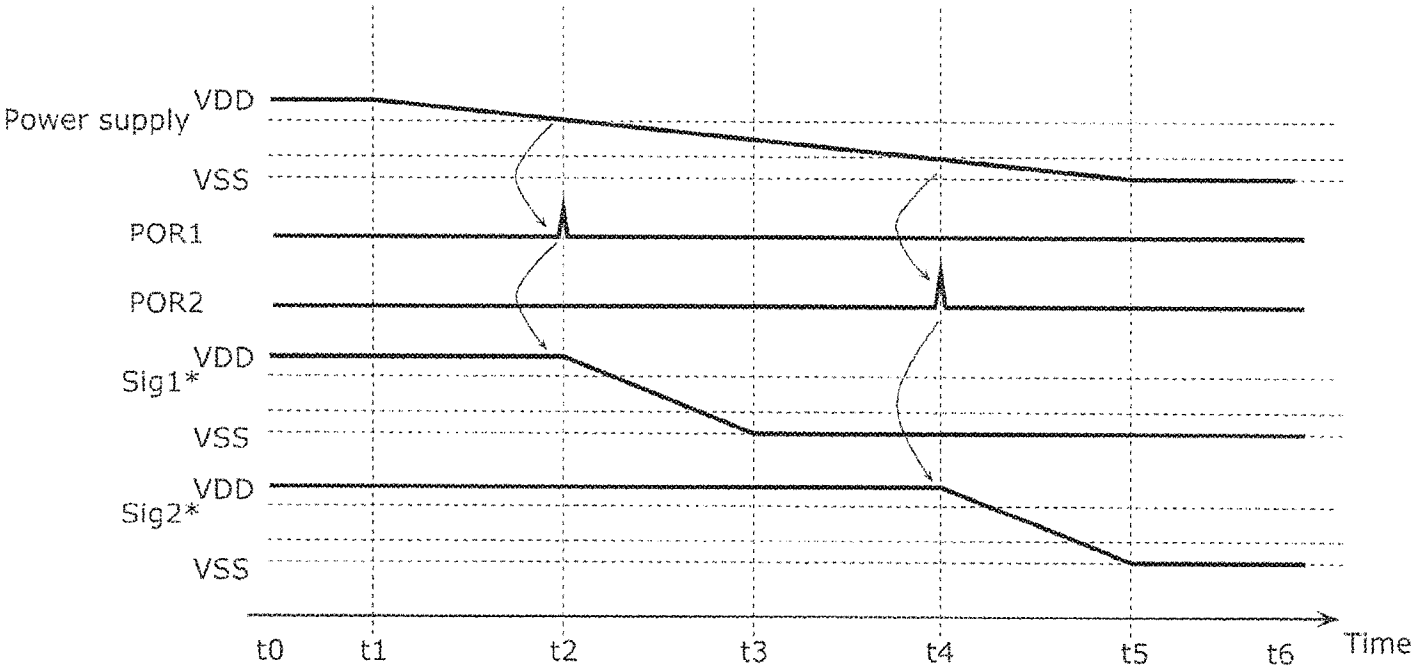
FIG. 4 is a timing chart showing a power supply stop operation performed in the display device according to Embodiment 1.
Figure 5:
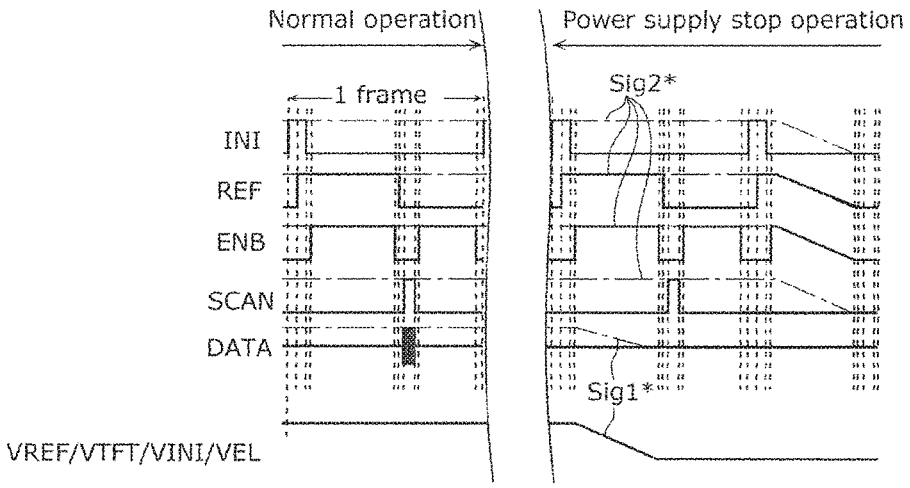
FIG. 5 is a timing chart showing an example of detailed timing of a normal operation and a power supply stop operation performed in the display device according to Embodiment 1.
Figure 6:
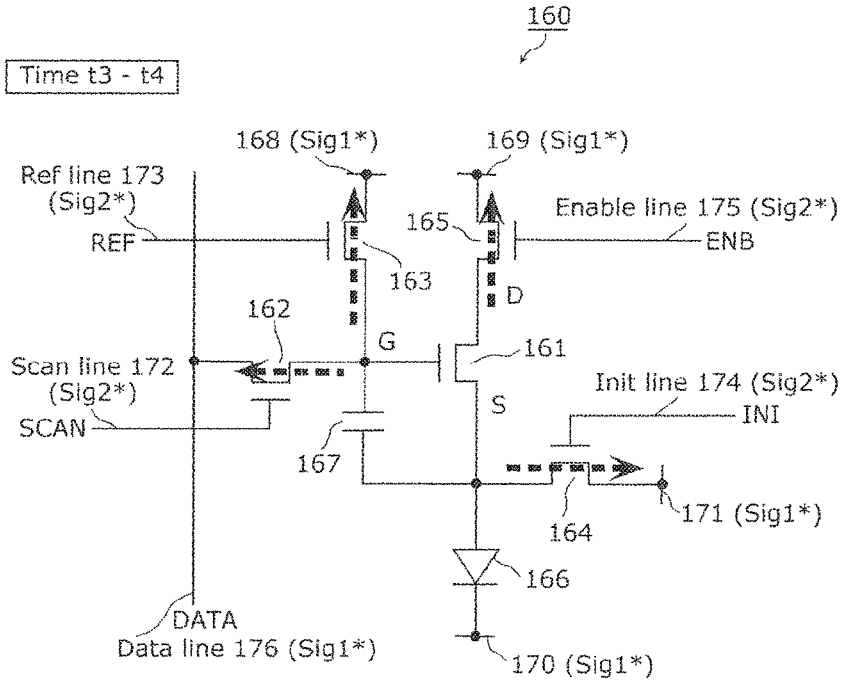
FIG. 6 is an illustrative diagram illustrating that electric charges are drawn from each node of a driving transistor according to Embodiment 1.

FIG. 4 is a timing chart showing a power supply stop operation performed in the display device 1 according to the present embodiment. FIG. 5 is a timing chart showing an example of detailed timing of a normal operation and a power supply stop operation performed in the display device according to the present embodiment. FIG. 6 is an illustrative diagram illustrating that electric charges are drawn from each node of the driving transistor 161 according to the present embodiment. As used herein, a node of the driving transistor 161 refers to the gate, drain or source of the driving transistor 161.

In FIG. 4, the power supply voltage of the display device 1, the detection signal POR1, the detection signal POR2, the voltage Sig1* corresponding to the panel control signal Sig1 among the supply voltages supplied to the pixel array 34, and the voltage Sig2* corresponding to the panel control signal Sig2 among the supply voltages supplied to the pixel array 34 are shown. Note, however, that Sig1* and Sig2* shown in the diagram are examples that schematically show tendencies of the supply voltages supplied to the pixel array 34. That is, the supply voltages supplied to the pixel array 34 do not necessarily reach the minimum voltage VSS and the maximum voltage VDD as indicated by Sig1* and Sig2* in the diagram. Also, the supply voltages supplied to the pixel array 34 may be pulsed waveforms whose high level voltages show tendencies as indicated by Sig1* and Sig2* in the diagram.

Also, in FIG. 5, various types of power supply voltages and various types of signals that are supplied to the pixel array 34 are shown. As used herein, various types of power supply voltages are VINI, VREF, VTFT, and VEL, and various types of signals are a scan signal SCAN, a REF signal REF, an enable signal ENB, an init signal INI, and a signal voltage DATA.

[1-2-1. Normal Operation]

A normal operation performed in the display device 1 according to the present embodiment will be described first. Here, the normal operation refers to an operation of the display device 1 performed before power supply to the display device 1 is stopped (before time t1 in FIG. 4). The normal operation may be an operation performed before a stop of power supply is detected by the detection unit 10 before time t2 in FIG. 4).

As shown in FIG. 4, in the normal operation, predetermined voltages are supplied as various types of power supply voltages and various types of signals at a predetermined timing. To be specific, as shown in FIG. 5, in the normal operation, various types of power supply voltages are continuously supplied at constant voltage levels, and with respect to each of various signals, a constant voltage (a high level voltage that places the switches 162 to 165 in a conducting state) is supplied at a predetermined timing. Accordingly, in the normal operation, the pixel 160 operates in the following manner (i) to (iv).

To be specific, (i) INI is changed to a high level and REF is changed to a high level so as to place the switches 163 and 164 in a conducting state, and an initial voltage required to deliver a drain current for performing threshold voltage compensation of the driving transistor 161 is stored in the capacitor 167 (initialization operation). Next, (ii) INI is changed to a low level, and thereafter ENB is changed to a high level so as to place the switch 165 in a conducting state to deliver the drain current. By doing so, a voltage corresponding to the threshold voltage of the driving transistor 161 is stored in the capacitor 167 (threshold value compensation operation). After that, (iii) ENB and RFF are changed to a low level, and thereafter SCAN is changed to a high level so as to place the switch 162 in a conducting state to write the signal voltage DATA (write operation). Finally, (iv) ENB is changed to a high level so as to place the switch 165 in a conducting state to cause the EL element 166 to emit light (light emitting operation).

With the operation described above, in the normal operation, the display device 1 can emit light while suppressing variation in the threshold voltage of the driving transistor 161 of each pixel 160.

[1-2-2. Power Supply Stop Operation]

In the pixel 160, the gate of the driving transistor 161 is connected to the Data line 176 via the switch 162. Also, the gate is connected to the reference voltage power supply line 168 via the switch 163. That is, when the switches 162 and 163 are placed in a non-conducting state, the gate is brought into a floating state in which the gate is not connected to any of the wiring lines.

Thus, when the power supply voltage to the display device 1 is stopped, the electric charges in the gate of the driving transistor 161 may not be sufficiently drawn. The reason is as follows.

To be specific, usually, a thin film transistor is used as the driving transistor 161 because it has a high electron mobility. In particular, an oxide thin film transistor is suitable for use as the driving transistor 161 because it has an advantage of having a very small leakage current when it is off and having a leakage current in pA order. However, because the oxide thin film transistor has a very small leakage current, electric charges before the power supply to the display device 1 is stopped are held inside each pixel 160 even after the power supply has been stopped.

The electric charges held in the gate of the driving transistor 161 may cause the following problem.

To be specific, the voltage applied to the driving transistor 161 due to the electric; charges acts as an electrical stress on the driving transistor 161. As a result, a threshold voltage shift may occur in the driving transistor 161. That is, a degradation may occur in the reliability and the characteristics of the driving transistor 161. The degradation of the transistor in a pixel as described above may affect the characteristics and the reliability of the display device.

Accordingly, in the display device 1 according to the present embodiment, the above-described problem is solved by drawing the electric charges held in the gate of the driving transistor 161 when the power supply to the display device 1 is stopped. Hereinafter, the power supply stop operation performed in the display device 1 according to the present embodiment will be specifically described.

As shown in FIG. 4, at time t1, when the power supply to the display device 1 is stopped by, for example, the power button on the main body of the display device 1 being pressed, the power supply voltage decreases gradually after time t1.

At time t2, when the power supply voltage decreases to the first threshold voltage or less, a detection signal POR1 is output by the detection unit 10. Thus, a panel control signal Sig1 for causing a power supply stop operation to be performed is output to the display panel 30 by the panel control unit 20.

Accordingly, among the supply voltages supplied to the pixel array 34, the voltages corresponding to the panel control signal Sig1 (in the present embodiment, VINI, VREF, VTFT, VEL, and DATA) decrease as indicated by Sig1* in the diagram.

As a result, at time t3, the voltages corresponding to the panel control signal Sig1 (in the present embodiment, VINI, VREF, VTFT, VEL, and DATA) decrease to a low level voltage (for example, VSS).

Next, at time t4, when the power supply voltage decreases to the second threshold voltage or less, a detection signal POR2 is output by the detection unit 10. Thus, a panel control signal Sig2 for causing a power supply stop operation to be performed is output to the display panel 30 by the panel control unit 20. Accordingly, among the supply voltages supplied to the pixel array 34, the voltages corresponding to the panel control signal Sig2 (in the present embodiment, scan signal SCAN, REF signal REF, enable signal ENB, and init signal INI) decrease as indicated by Sig2* in the diagram.

Here, during a period between time t3 and time t4, Sig1* is decreased to the low level voltage, but Sig2* is not decreased. Accordingly, as shown in FIG. 5, INI, REF, ENB and SCAN that are the voltages (signals) corresponding to the panel control signal Sig2 are changed to a high level as in the normal operation so as to place the switches 162 to 165 in a conducting state.

By doing so, during the period between time t3 and time t4, the electric charges held in the gate, the drain and the source of the driving transistor 161 are drawn as shown in FIG. 6.

To be specific, the electric charges held in the gate of the driving transistor 161 are drawn into the Data line 176, to which a low level voltage (for example, VSS) is applied, via the switch 162. Furthermore, the electric charges held in the gate are also drawn into the reference voltage power supply line 168, to which a low level voltage (for example, VSS) is applied, via the switch 163. To be more specific, the electric charges held in the gate of the driving transistor 161 are drawn into the data line driving circuit 32 via the switch 162 and the Data line 176 or drawn into the power supply unit 31 via the switch 163 and the reference voltage power supply line 168.

Also, the electric charges held in the drain of the driving transistor 161 are drawn into the EL anode power supply line 169, to which a low level voltage (for example, VSS) is applied, via the switch 165. To be more specific, the electric charges held in the drain of the driving transistor 161 are drawn into the power supply unit 31 via the switch 165 and the EL anode power supply line 169.

Also, the electric charges held in the source of the driving transistor 161 are drawn into the initialization power supply line 171, to which a low level voltage (for example, VSS) is applied, via the switch 164. To be more specific, the electric charges held in the source of the driving transistor 161 are drawn into the power supply unit 31 via the switch 164 and the initialization power supply line 171.

After that, during a period between time t4 and time t5, Sig*2 decreases as well along with the decrease of the power supply voltage. At time t5, when the power supply voltage reaches a low level (for example, VSS), Sig*2 also reaches the low level. That is, after time t5, the switches 162 to 164 are placed in a non-conducting state, and thus the gate, the drain and the source of the driving transistor 161 are brought into a floating state.

As described above, in the display device 1 according to the present embodiment, if a stop of power supply is detected by the detection unit 10, various types of power supply voltages and signal voltages (VINI, VREF, VTFT, VEL, and DATA) are decreased, and thereafter the switches 162 to 165 are placed in a conducting state. By doing so, the display device 1 can draw the electric charges held in the gate, the drain and the source of the driving transistor 161 via the switches 162 to 165.

Here, as described above, the electric charges held in the gate, the drain and the source of the driving transistor 161 are drawn during the period between time t3 and time t4 described above. Accordingly, at time t5, when the gate, the drain and the source of the driving transistor 161 are brought into a floating state, the electric charges held in the gate, the drain and the source can be suppressed.

Accordingly, in the display device 1 according to the present embodiment, it is possible to suppress a load applied to the driving transistor 161 that is generated due to electric charges being held in the gate of the driving transistor 161 when it is in a floating state. That is, in the display device 1, the degradation in the reliability and the characteristics of the driving transistor 161 can be suppressed. As a result, the characteristics and the reliability of the display device 1 can be maintained.

It is sufficient that the period between time t3 and time t4 has, for example, a length that is longer than or equal to one frame. With this configuration, in all pixel rows, the switches 162 to 165 can be placed in a conducting state after various types of power supply voltages and signal voltages (VINI, VREF, VTFT, VEL, and DATA) are decreased to the low level voltage. Accordingly, in all pixel rows, the electric charges held in the gate, the drain and the source of the driving transistor 161 can be drawn via the switches 162 to 165.

Also, in the description given above, the drawing of electric charges from each pixel 160 is performed in a row sequential manner during the period between time t3 and time t4. That is, as in the normal operation, in the power supply stop operation as well, electric charges are drawn from all pixels 160 by changing the scan signal SCAN, the REF signal REF, the enable signal ENB and the init signal INI to a high level in a row sequential manner. With this configuration, it is unnecessary for the scan line driving circuit 33 to change the timing at which the scan signal SCAN, the REF signal REF, the enable signal ENB and the init signal INI are changed to a high level between the normal operation and the power supply stop operation, and thus electric charges can be drawn with simple control.

The drawing of electric charges from each pixel 160 may be performed simultaneously at any timing during the period between time t3 and time t4. That is, in all pixel rows, the scan signal SCAN, the REF signal REF, the enable signal ENB and the init signal INI may be changed to a high level after various types of power supply voltages and signal voltages (VINI, VREF, VTFT, VEL, and DATA) are decreased to the low level voltage. With this configuration, the time required to draw electric charges can be shortened.

[1-3. Advantageous Effects, Etc.]

As described above, the display device 1 according to the present embodiment is a display device including a plurality of pixels 160 arranged in a matrix, each of the plurality of pixels 160 including an EL element 166 that emits light according to the amount of current supplied, a driving transistor 161 that controls light emission of the EL element 166, and switches 162 and 163 that serve as a first switch connected to the gate of the driving transistor 161. The display device 1 includes an electric charge drawing unit configured to draw the electric charges held in the gate in each of the plurality of pixels 160 when the power supply to the display device 1 is stopped.

As described above, in the display device 1 according to the present embodiment, when the power supply to the display device 1 is stopped, the electric charges held in the gate of the driving transistor 161 are drawn. Accordingly, it is possible to suppress a load (electrical stress) applied to the driving transistor 161 while the power supply to the display device 1 is stopped. Thus, the display device 1 according to the present embodiment can suppress the degradation of the driving transistor 161 provided in each pixel 150 while the power supply is stopped. That is, it is possible to attain long term reliability of the display device 1.

Here, in the present embodiment, the electric charge drawing unit that draws the electric charges held in the gate of the driving transistor 151 provided in each of a plurality of pixels 160 when the power supply to the display device 1 is stopped corresponds to the detection unit 10, the panel control unit 20, the power supply unit 31, the data line driving circuit 32, and the scan line driving circuit 33.

That is, in the present embodiment, the electric charge drawing unit includes the detection unit 10 that detects a stop of power supply by detecting a decrease in the power supply voltage supplied from outside the display device 1.

With this configuration, the stop of power supply be detected before the power supply voltage of the display device 1 reaches a low level voltage (for example, VSS). Accordingly, even when the internal voltage is necessary for the electric charge drawing unit to draw electric charges, it is possible to draw the electric charges held in the gate of the driving transistor 161.

Also, the electric charge drawing unit draws electric charges by placing the switches 162 and 163 in a conducting state when a stop of power supply is detected by the detection unit 10.

As described above, in the present embodiment, electric charges are drawn by placing the switches 162 and 163 provided in each pixel 160 in a conducting state. Accordingly, it is unnecessary to provide an additional configuration for drawing electric charges, and thus the pixel configuration can be simplified.

To be specific, the switches 162 and 163 switch the electrical connection between the Data line 176 that is the first wiring line in the present embodiment and the reference voltage power supply line 168 or the gate of the driving transistor 161 between a conducting state and a non-conducting state, and if a stop of power supply is detected by the detection unit 10, the electric charge drawing unit places the switches 162 and 163 (serving as the first switch) in a conducting state after the voltages of the Data line 176 and the reference voltage power supply line 168 reach a low level voltage.

Here, the Data line 176 and the reference voltage power supply line 168 are power supply lines that supply a power supply voltage for controlling light emission of the EL element 166 to a plurality of pixels 160 or signal lines that supply a signal voltage DATA corresponding to the brightness level of the EL element 166 to the plurality of pixels 160.

As described above, in the present embodiment, the voltage of the Data line 176 and the reference voltage power supply line 168 to which the power supply voltage or the signal voltage is supplied during a normal operation in which power is supplied to the display device 1 is decreased to a low level voltage (for example, VSS) in a power supply stop operation in which the power supply is stopped. That is, in the present embodiment, electric charges can be drawn via the Data line 176 and the reference voltage power supply line 168 by switching the voltage of the Data line 176 and the reference voltage power supply line 168 between when the normal operation is performed and when the power supply stop operation is performed. That is, it is unnecessary to provide an additional configuration for drawing electric charges, and thus the configuration can be simplified.

Also, for example, the low level voltage (for example, VSS) is a voltage that reduces an electric stress applied to the driving transistor 161.

With this configuration, when an equilibrium state is reached as a result of electric charges being drawn from the gate of the driving transistor 161, or in other words, when the drawing of electric charges has been completed, the voltage of the gate reaches a voltage that reduces an electrical stress applied to the driving transistor 161. Accordingly, the degradation of the reliability and the characteristics of the driving transistor 161 can be further suppressed.

In the present embodiment, an example was described in which the low level voltage (for example, VSS such as 0 [V]) is used as the voltage that can reduce the electrical stress, but the present embodiment is not limited thereto. For example, the voltage that can reduce the electrical stress may be a voltage that causes the gate-to-source voltage of the driving transistor 161 to be the threshold voltage of the driving transistor 161.

(Variation of Embodiment 1)

Figure 7:
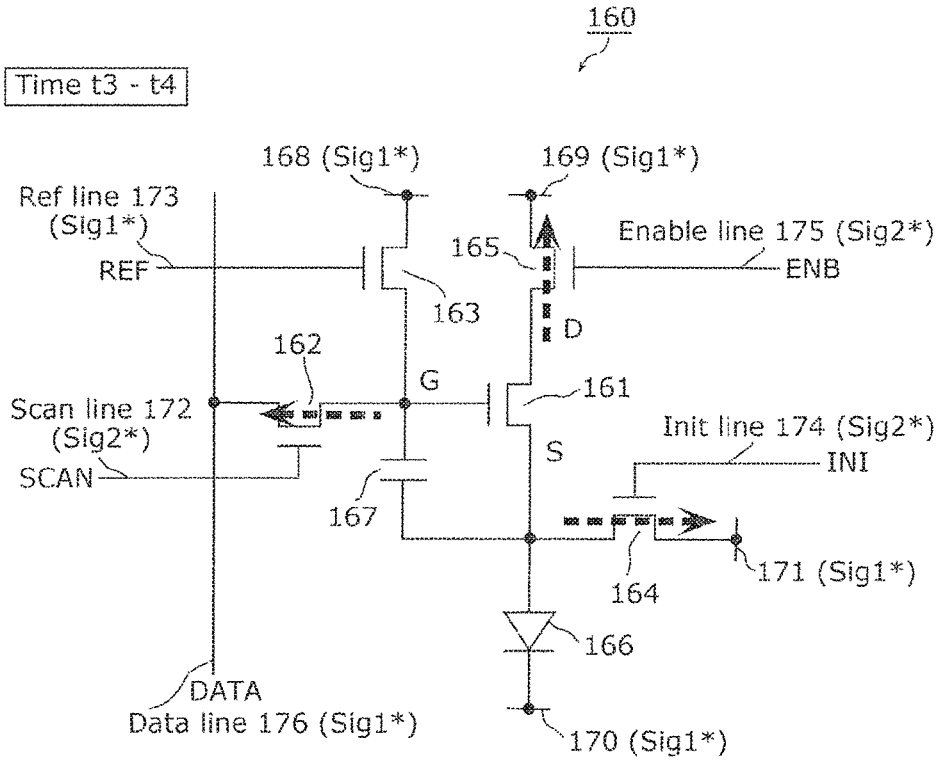
FIG. 7 is an illustrative diagram illustrating an example in which electric charges are drawn from each node of a driving transistor according to a variation of Embodiment 1.
Figure 8:
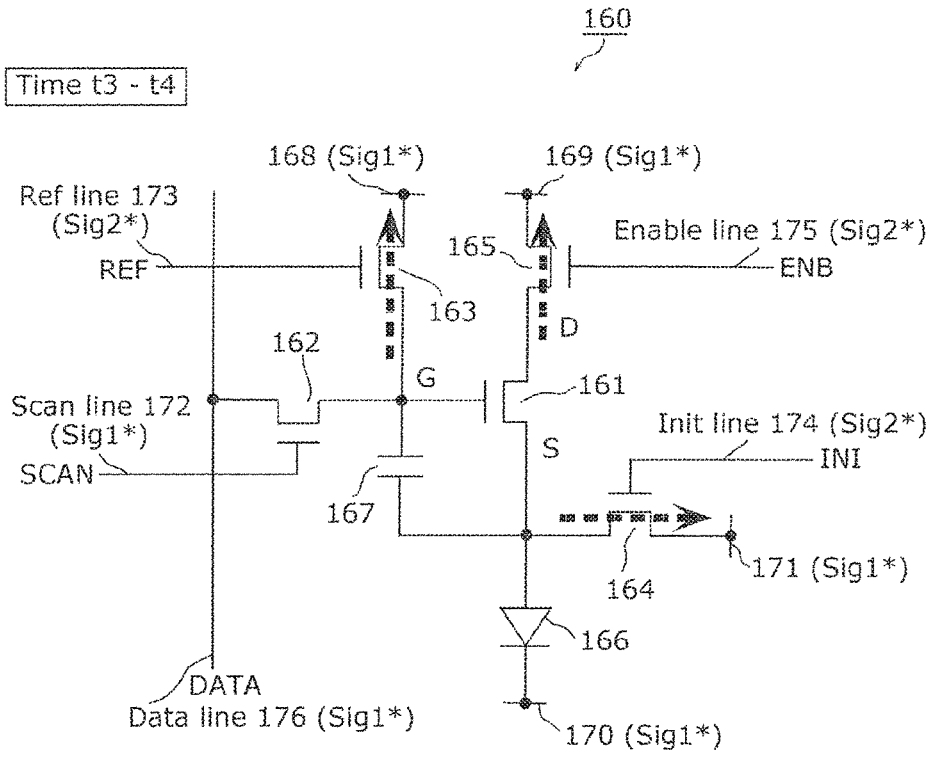
FIG. 8 is an illustrative diagram illustrating another example in which electric charges are drawn from each node of a driving transistor according to a variation of Embodiment 1.

Embodiment 1 described above is configured such that, when the power supply to the display device 1 is stopped, the electric charges held in the gate of the driving transistor 161 are drawn into the data line driving circuit 32 and the power supply unit 31 via the switch 162 and Data line 176 and via the switch 163 and the reference voltage power supply line 168. However, it is possible to use a configuration as shown in FIGS. 7 and 8 in which, when the power supply to the display device 1 is stopped, the electric charges held in the gate of the driving transistor 161 are drawn either via the switch 162 and the Data line 176 or via the switch 163 and the reference voltage power supply line 168. FIGS. 7 and 8 are illustrative diagrams illustrating that electric charges are drawn from each node of the driving transistor 151 according to a variation of Embodiment 1. To be specific, these diagrams are illustrative diagrams illustrating the state of the pixel 160 during the period between time t3 and time t4 shown in FIG. 4 according to a variation of Embodiment 1.

That is, as shown in FIGS. 6 to 8, the power supply unit 31 and the data line driving circuit 32 may be configured to, if a stop of power supply is detected by the detection unit 10, draw the electric charges held in the gate of the driving transistor 161 by placing at least one of the switches 162 and 163 connected to the gate of the driving transistor 161 in a conducting state. To be specific, the power supply unit 31 and the data line driving circuit 32 may be configured to, if a stop of power supply is detected by the detection unit 10, place at least one of the switches 152 and 163 in a conducting state after the voltage of the wiring line (the Data line 176 or the reference voltage power supply line 168) connected to at least one of the switches 162 and 163 reaches a low level voltage (VSS).

To rephrase, in Embodiment 1 given above, among the supply voltages supplied to the pixel array 34, the voltages corresponding to the panel control signal Sig1 are VINI, VREF, VTFT, VEL, and DATA. Also, among the supply voltages supplied to the pixel array 34, the voltages (signals) corresponding to the panel control signal Sig2 are the scan signal SCAN, the REF signal REF, the enable signal ENB, and the init signal INI. However, the association between the panel control signals Sig1 and Sig2 and the supply voltages supplied to the pixel array 34 is not limited to that of Embodiment 1 given above.

That is, the voltages (signals) corresponding to the panel control signal Sig1 may be VINI, VREF, VTFT, VEL, DATA, and the REF signal REF, and the voltages (signals) corresponding to the panel control signal Sig2 may be the scan signal SCAN, the enable signal ENB, and the init signal INI. With this configuration, as shown in FIG. 7, when the power supply to the display device 1 is stopped, the electric charges held in the gate of the driving transistor 161 are drawn via the switch 162 and the Data line 176.

Also, the voltages (signals) corresponding to the panel control signal Sig1 may be VINI, VREF, VTFT, VEL, DATA, and the scan signal SCAN, and the voltages (signals) corresponding to the panel control signal Sig2 may be the REF signal REF, the enable signal ENB, and the init signal INI. With this configuration, as shown in FIG. 8, when the power supply to the display device 1 is stopped, the electric charges held in the gate of the driving transistor 161 are drawn via the switch 163 and the reference voltage power supply line 168.

(Embodiment 2)

Next, Embodiment 2 according to the present disclosure will be described focusing on differences from Embodiment 1.

Embodiment 1 given above is configured such that, when the power supply to the display device 1 is stopped, the electric charges held in the gate of the driving transistor 161 are drawn via the switches 162 and 163 for controlling the light emission of the EL element 166 during the normal operation. In the present embodiment, a switch other than the switches 162 and 163 is provided, the switch being for drawing the electric charges held in the gate of the driving transistor 161 when the power supply to the display device 1 is stopped.

[2-1. Configuration]

[2-1-1. Display Device]

First, a configuration of a display device according to the present embodiment will be described with reference to FIGS. 9 and 10.

Figure 9:
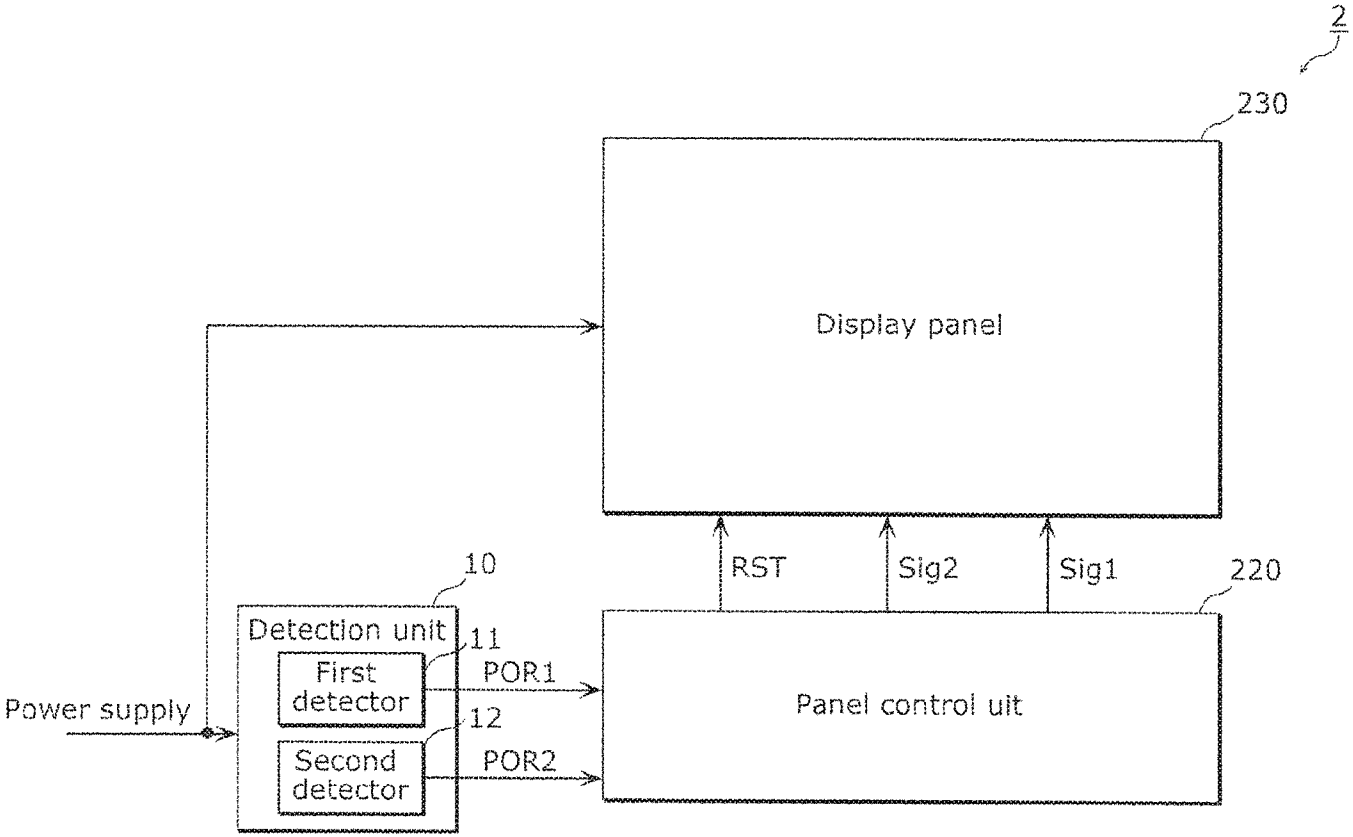
FIG. 9 is a block diagram showing an example of a configuration of a display device according to Embodiment 2.
Figure 10:
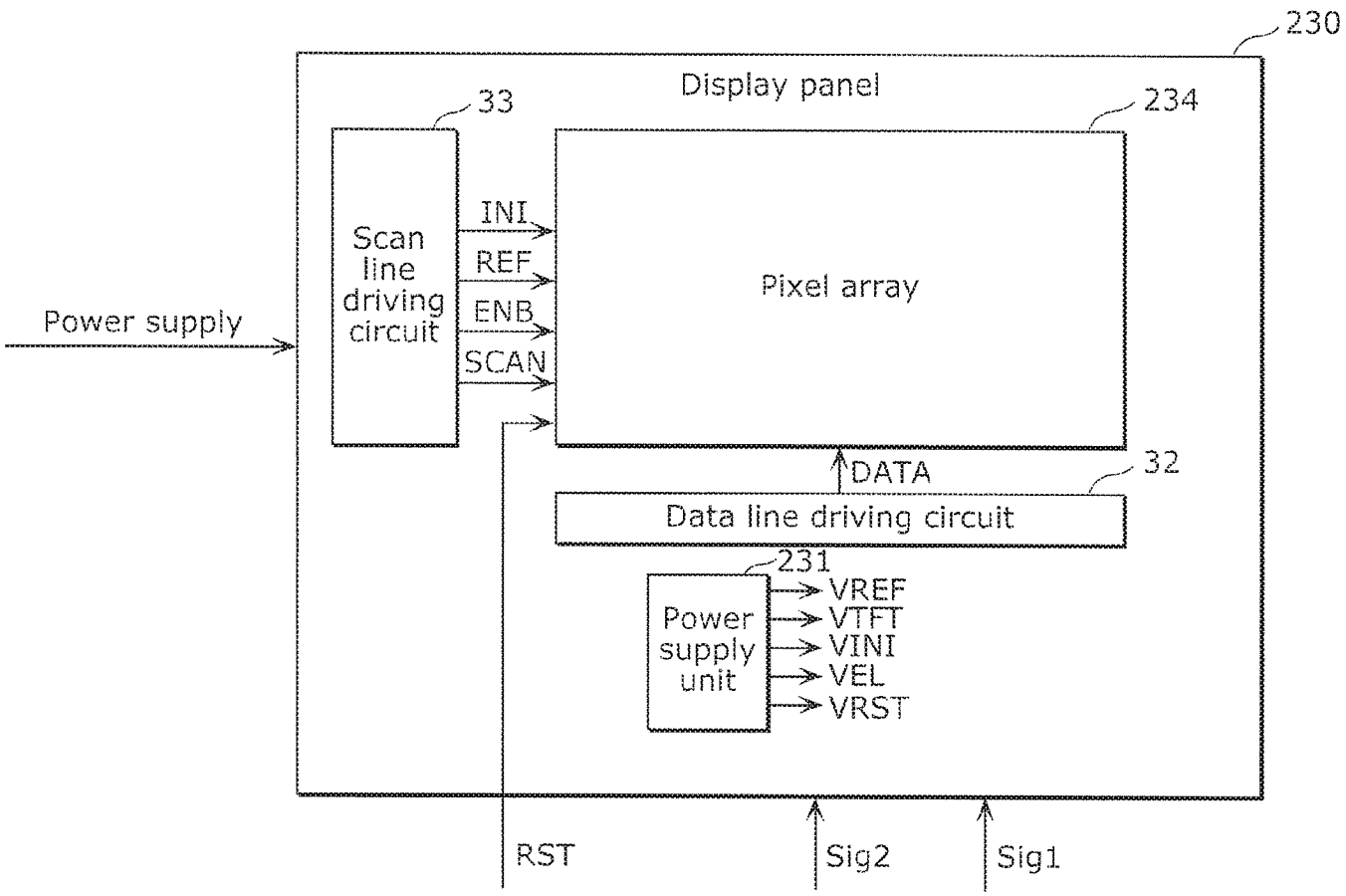
FIG. 10 is a block diagram showing an example of a configuration of a display panel shown in FIG. 9.

FIG. 9 is a block diagram showing an example of a configuration of a display device according to Embodiment 2. FIG. 10 is a block diagram showing an example of a configuration of a display panel shown in FIG. 9.

As shown in these diagrams, a display device 2 according to the present embodiment is substantially the same as the display device 1 according to Embodiment 1, except that the signals output from a panel control unit 220 to a display panel 230 and the configuration of the display panel 230 are different.

The panel control unit 220 is different from the panel control unit 20 of Embodiment 1 in that the panel control unit 220 further outputs a reset signal RST. To be specific, the panel control unit 220 outputs a reset signal RST to the display panel 230 if a stop of power supply is detected by the detection unit 10. To be more specific, the panel control unit 220 outputs a reset signal RST that is set to a high level during a period from when a detection signal POR1 is output from the first detector 11 until when a detection signal POR2 is output from the second detector 12.

Also, the panel control unit 20 of Embodiment 1 is configured to output the panel control signal Sig1 when the detection signal POR1 is output from the first detector 11, and output the panel control signal Sig2 when the detection signal POR2 is output from the second detector 12, but the panel control unit 220 of the present embodiment is configured to output the panel control signals Sig1 and Sig2 when the detection signal POR2 is output from the second detector 12.

The display panel 230 is different from the display panel 30 of Embodiment 1 in that the voltage supplied by a power supply unit 231 is different. Also, the pixel configuration of the pixels disposed in a pixel array 234 is different.

The power supply unit 231 is different from the power supply unit 31 of Embodiment 1 in that the power supply unit 231 further supplies a reset voltage VRST to the pixel array 234. As used herein, the reset voltage VRST is, for example, a voltage (for example, 0 [V]) that reduces an electrical stress applied to the driving transistor 161.

The pixel array 234 is different from the pixel array 34 of Embodiment 1 in that the pixel array 234 has a different pixel configuration.

[2-1-2. Pixel]

Figure 11:
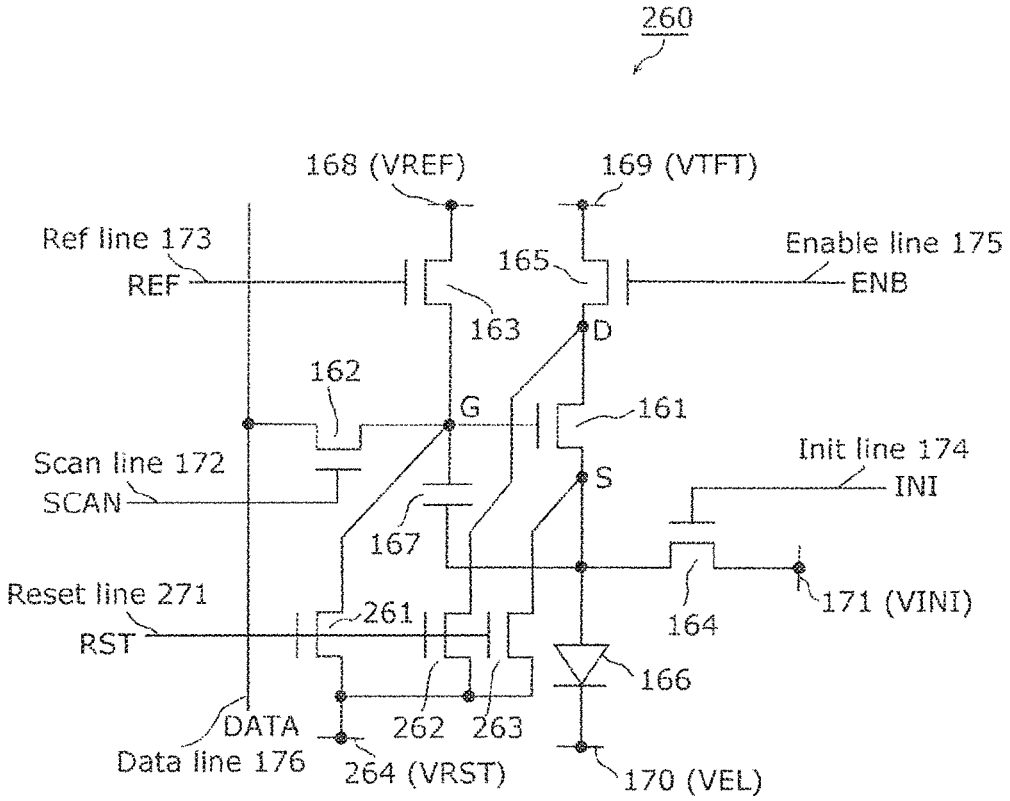
FIG. 11 is a circuit diagram showing a configuration of a pixel according to Embodiment 2.

Next, an example of a configuration of a pixel disposed in the pixel array 234 will be described with reference to FIG. 11. FIG. 11 is a circuit diagram showing a configuration of a pixel according to Embodiment 2.

A pixel 260 shown in FIG. 11 is different from the pixel 160 according to Embodiment 1 in that the pixel 260 further includes switches 261 to 263.

The switch 261 switches the electrical connection between a reset power supply line 264 that supplies the reset voltage VRST and the gate of the driving transistor 161 between a conducting state and a non-conducting state. To be specific, the switch 261 is a switching transistor in which one terminal of the drain and the source is connected to the reset power supply line 264 (VRST), the other terminal of the drain and the source is connected to the gate of the driving transistor 161, and the gate is connected to a Reset line 271.

The switch 262 is connected in the same manner as the switch 261 except that the other terminal of the drain and the source is connected to the drain of the driving transistor 161. The switch 263 is connected in the same manner as the switch 261 except that the other terminal of the drain and the source is connected to the source of the driving transistor 161.

[2-2. Operation]

Next, an operation of the display device 2 according to the present embodiment configured as described above will be described with reference to FIGS. 12 and 13.

Figure 12:
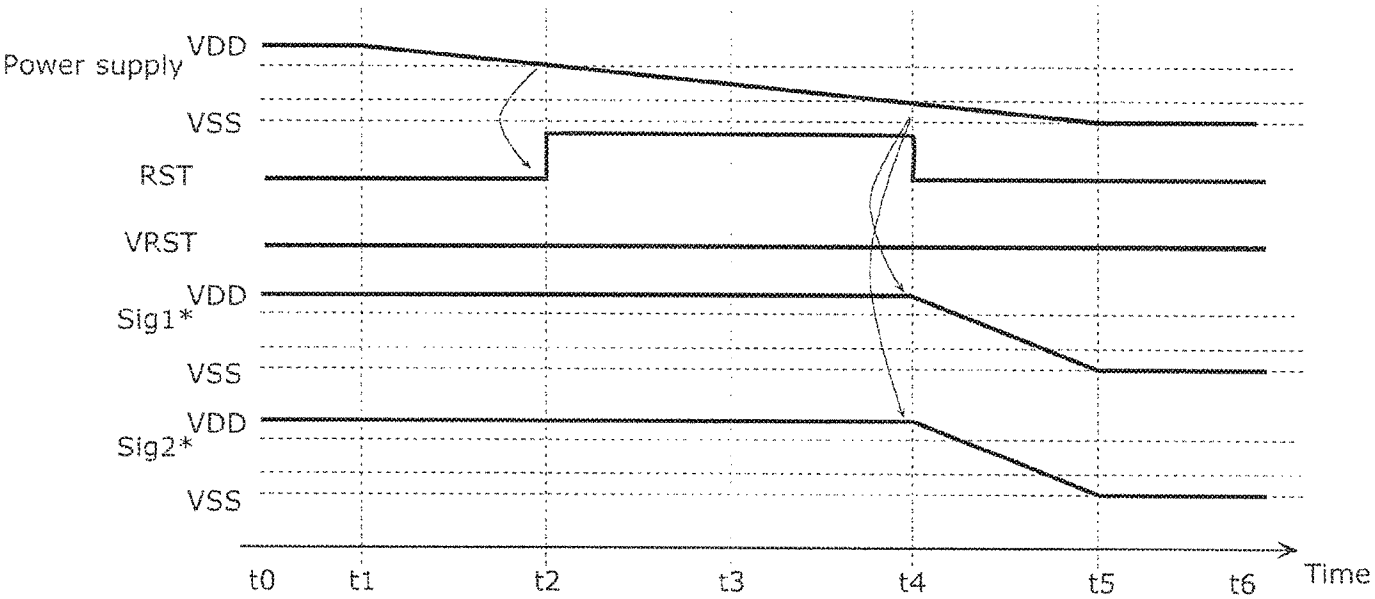
FIG. 12 is a timing chart showing a power supply stop operation in a display device according to Embodiment 2.
Figure 13:
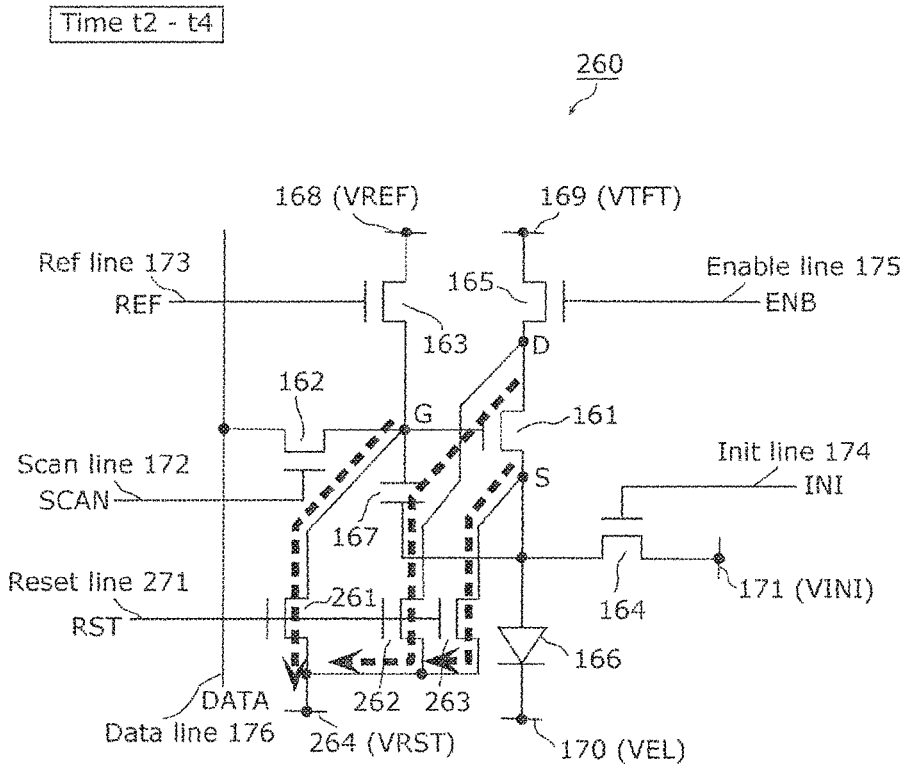
FIG. 13 is an illustrative diagram illustrating that electric charges are drawn from each node of a driving transistor according to Embodiment 2.

FIG. 12 is a timing chart showing a power supply stop operation performed in the display device according to the present embodiment. FIG. 13 is an illustrative diagram illustrating that electric charges are drawn from each node of the driving transistor 161 according to the present embodiment.

In FIG. 12, the power supply voltage of the display device 2, the reset signal RST, the reset voltage VRST, the voltage Sig1* corresponding to the panel control signal Sig1 among the supply voltages supplied to the pixel array 234, and the voltage Sig2* corresponding to the panel control signal Sig2 among the supply voltages supplied to the pixel array 234 are shown. Note, however, that Sig1* and Sig2* shown in the diagram are examples that schematically show tendencies of the supply voltages supplied to the pixel array 234. That is, the supply voltages supplied to the pixel array 234 do not necessarily reach the minimum voltage VSS and the maximum voltage VDD as indicated by Sig1* and Sig2* in the diagram. Also, the supply voltages supplied to the pixel array 234 may be pulsed waveforms whose high level voltages show tendencies as indicated by Sig1* and Sig2* in the diagram.

[2-2-1. Normal Operation]

A normal operation performed in the display device 2 according to the present embodiment is the same as that of Embodiment 1. That is, during the normal operation in which the power supply voltage is supplied to the display device 2, the display device 2 sequentially performs the following operations: (i) initialization operation, (ii) threshold value compensation operation, (iii) write operation, and (iv) light emitting operation, which were explained in Embodiment 1. The display device 2 can thereby emit light while suppressing variation in the threshold value of the driving transistor 161 provided in each pixel 260.

[2-2-2. Power Supply Stop Operation]

Next, a power supply stop operation performed by the display device 2 according to the present embodiment will be described specifically.

As shown in FIG. 12, at time t1, when the power supply to the display device 2 is stopped by, for example, the power button on the main body of the display device 2 being pressed, the power supply voltage decreases gradually after time t1.

At time t2, when the power supply voltage decreases to the first threshold voltage or less, a detection signal POR1 is output by the detection unit 10. Thus, RST is increased to a high level by the panel control unit 220. Accordingly, the switches 261 to 263 are placed in a conducting state.

Next, at time t4, when the power supply voltage decreases to the second threshold voltage or less, a detection signal POR2 is output from the detection unit 10. Thus, RST is decreased to a low level by the panel control unit 220. Accordingly, the switches 261 to 263 are placed in a non-conducting state. Also, panel control signals Sig1 and Sig2 for causing a power supply stop operation to be performed are output to the display panel 230 by the panel control unit 220. Accordingly, among the supply voltages supplied to the pixel array 234, the voltages corresponding to the panel control signals Sig1 and Sig2 (in the present embodiment, scan signal SCAN, REF signal REF, enable signal ENB, init signal INI, VINI, VREF, VTFT, VEL, and DATA) decrease as indicated by Sig1* and Sig2* in the diagram.

Here, during a period between time t2 and time t4, RST is in a high level, and thus the switches 261 to 263 are in a conducting state.

Accordingly, during the period between time t2 and time t4, as shown in FIG. 13, the electric charges held in the gate, the drain and the source of the driving transistor 161 are drawn into the reset power supply line 264 via the switches 261 to 263.

As described above, in the display device 2 according to the present embodiment, if a stop of power supply is detected by the detection unit 10, the switches 261 to 263 are placed in a conducting state. By doing so, the display device 2 can draw the electric charges held in the gate, the drain and the source of the driving transistor 161 via the switches 261 to 263.

Thus, the display device 2 according to the present embodiment has the same advantageous effects as those of the display device 1 according to Embodiment 1. That is, it is possible to suppress a load (electrical stress) applied to the driving transistor 161 while the power supply to the display device 2 is stopped. Accordingly, the display device 2 according to the present embodiment can suppress the degradation of the driving transistor 161 provided in each pixel 260 while the power supply is stopped.

[2-3. Advantageous Effects, Etc.]

As described above, the display device 2 according to the present embodiment is different from the display device 1 according to Embodiment 1 in that the display device 2 further includes a switch 261 that is a second switch connected to the gate of the driving transistor 161, and the electric charge drawing unit is configured to, if a stop of power supply is detected by the detection unit 10, place the switch 261 in a conducting state so as to draw electric charges.

With this configuration, it is possible to draw the electric charges held in the gate of the driving transistor 161 with simple control.

Here, in the present embodiment, the electric charge drawing unit that draws the electric charges held in the gate of the driving transistor 161 provided in each of a plurality of pixels 260 when the power supply to the display device 1 is stopped corresponds to the detection unit 10, the panel control unit 220, the power supply unit 231, the data line driving circuit 32, and the scan line driving circuit 33.

To be specific, the switch 261 switches the electrical connection between the gate of the driving transistor 161 and the reset power supply line 264 that is a second wiring line that is different from the first wiring line (the Data line 176 connected to the switch 162 and the reference voltage power supply line 168 connected to the switch 163) between a conducting state and a non-conducting state, and a low level voltage is applied to the reset power supply line 264.

With this configuration, it is unnecessary to switch the voltage of the reset power supply line 264, and it is therefore possible to draw the electric charges held in the gate of the driving transistor 161 with simpler control.

(Variation 1 of Embodiment 2)

Figure 14:
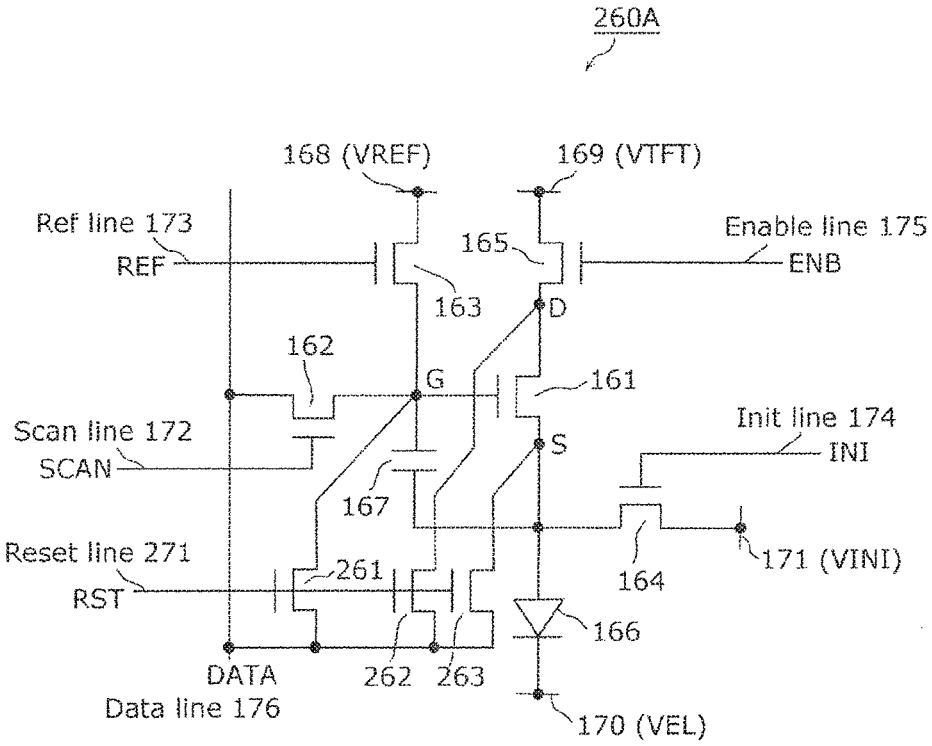
FIG. 14 is a circuit diagram showing a configuration of a pixel according to Variation 1 of Embodiment 2.

As shown in FIG. 14, the switches 261 to 263 may switch the electrical connection between each node of the driving transistor 161 and the Data line 176 between a conducting state and a non-conducting state. FIG. 14 is a circuit diagram showing a configuration of a pixel 260A according to Variation 1 of Embodiment 2.

In the pixel 260A shown in the diagram as well, if a stop of power supply to the display device 2 is detected by the detection unit 10, the switch 261 (second switch) is placed in a conducting state after the voltage of the Data line 176 (first wiring line) reaches a low level voltage (for example, 0 [V]). With this configuration, the same advantageous effects as those of Embodiments 1 and 2 are obtained.

(Variation 2 of Embodiment 2)

Also, Embodiment 2 is configured such that the electric charges held in each node of the driving transistor 161 are drawn when the power supply to the display device 2 is stopped, but the electric charges held in the drain and the source of the driving transistor 161 do not need to be drawn.

Figure 15:
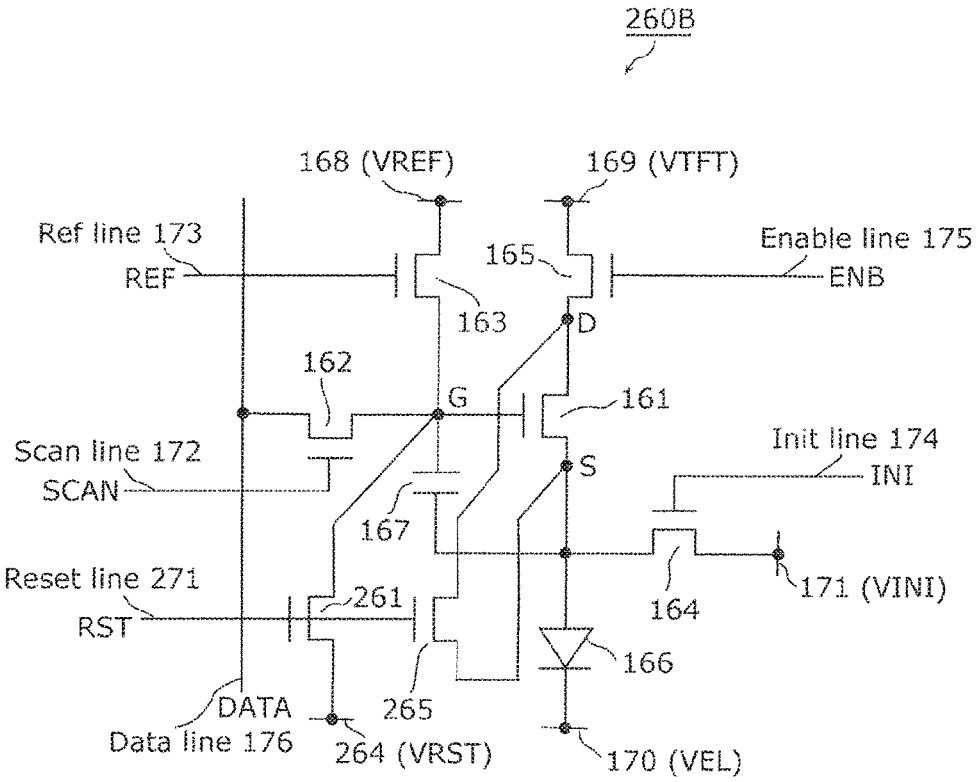
FIG. 15 is a circuit diagram showing a configuration of a pixel according to Variation 2 of Embodiment 2.

That is, as shown in FIG. 15, a pixel 260B may include a switch 265 that conducts between the drain and the source of the driving transistor 161 when the power supply to the display device 2 is stopped, without including the switches 262 and 263 provided in the pixel 260. FIG. 15 is a circuit diagram showing a configuration of the pixel 260B according to Variation 2 of Embodiment 2.

Even with this configuration, it is possible to suppress the degradation of the driving transistor 161 while the power supply to the display device is stopped.

(Variation 3 of Embodiment 2)

Also, resistor elements may be provided instead of the switches 261 to 263 of Embodiment 2. This configuration eliminates the need to control the switches 261 to 263 to be in a conducting state or a non-conducting state, and thus it is possible to draw the electric charges held in each node of the driving transistor 161 when the power supply to the display device is stopped, with a simple configuration and simple control.

Figure 16:
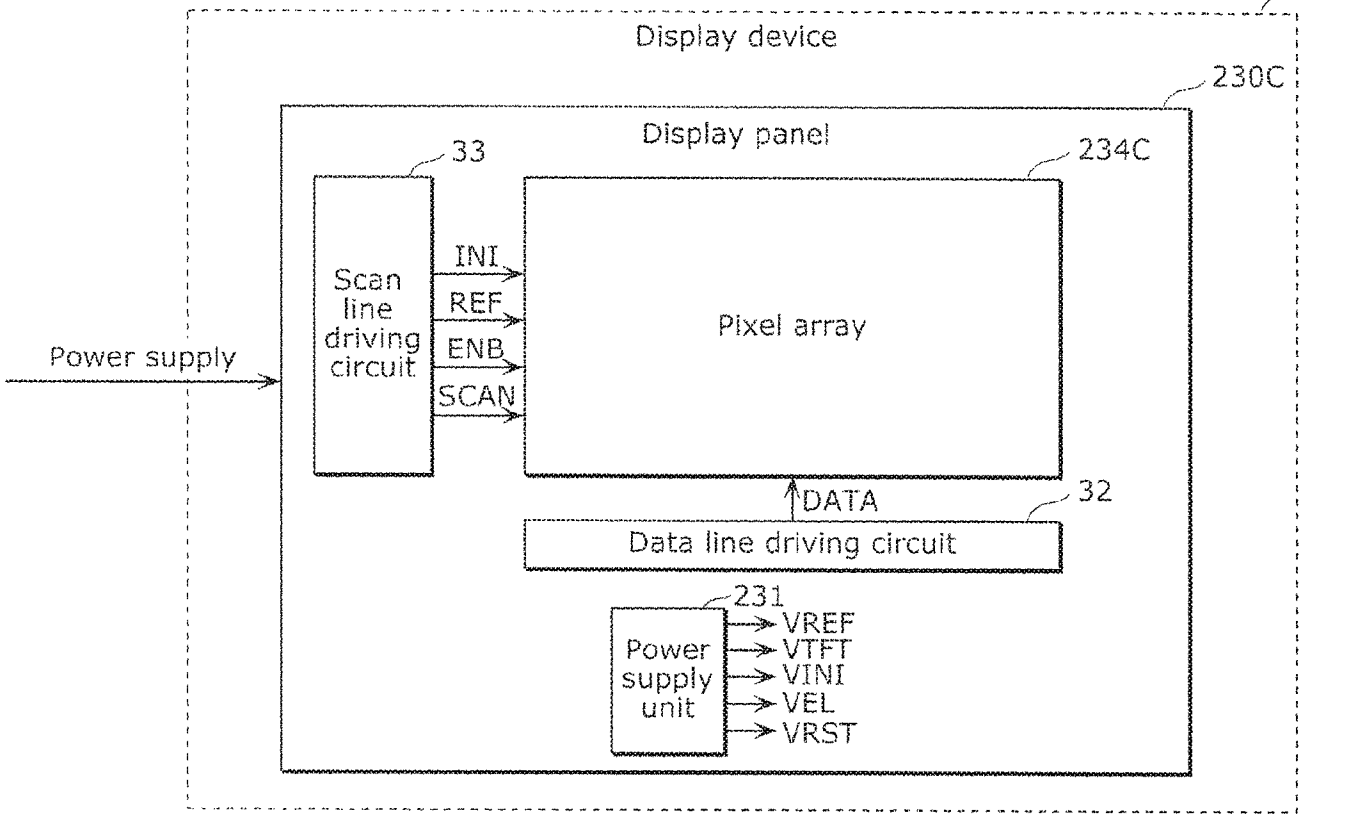
FIG. 16 is a block diagram showing a configuration of a display device according to Variation 3 of Embodiment 2.
Figure 17:
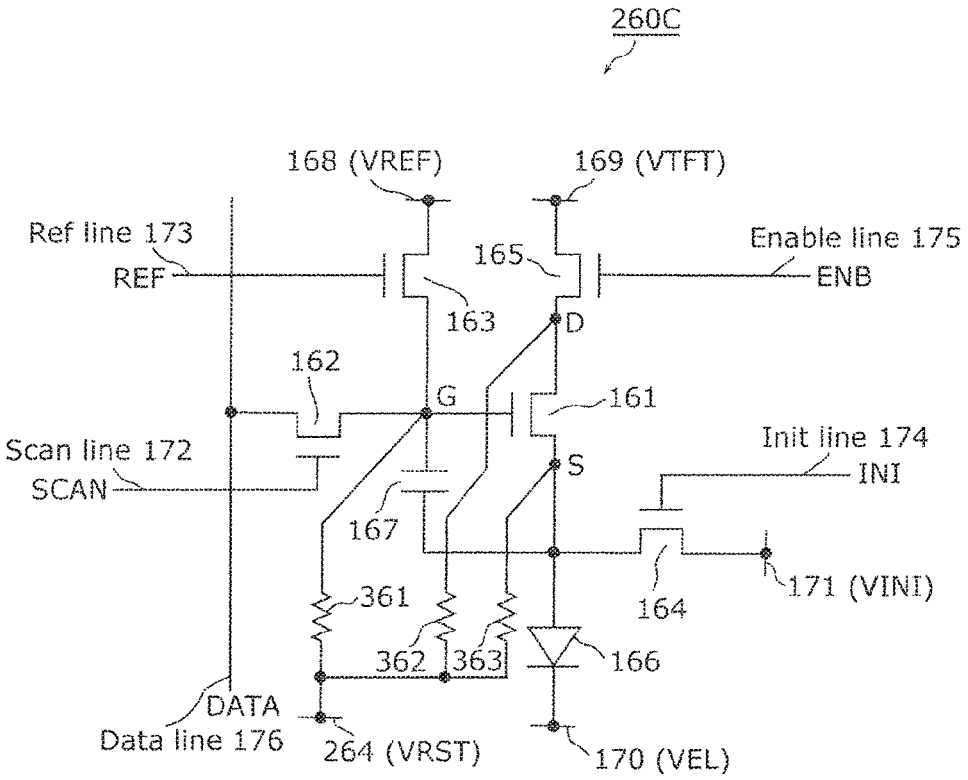
FIG. 17 is a circuit diagram showing a configuration of a pixel according to Variation 3 of Embodiment 2.

FIG. 16 is a block diagram showing a configuration of a display device 2C according to Variation 3 of Embodiment 2, and FIG. 17 is a circuit diagram showing a configuration of a pixel 260C according to Variation 3 of Embodiment 2.

As shown in FIG. 16, the display device 2C according to the present variation is different from the display device 2 according to Embodiment 2 in that the display device 2C does not include the detection unit 10 and the panel control unit 220.

Also, the display device 2C according to the present variation includes, instead of the display panel 230, a display panel 230C that includes a pixel array 234C. The pixel array 234C is different from the pixel array 234 of Embodiment 2 in that the pixels have a different configuration.

That is, Embodiment 2 is configured such that when the power supply to the display device 2 is stopped, the switches 261 to 263 are placed in a conducting state so as to draw the electric charges held in each node of the driving transistor 161. In contrast, the present variation is configured such that when the power supply to the display device 2C is stopped, resistors 361 to 363 discharge (draw) the electric charges held in each node of the driving transistor 161 according to time constants of the resistors 361 to 363.

To be specific, when the power supply to the display device 2C is stopped, the power supply voltage of the display device 2C decreases gradually. Thus, VRST decreases gradually to a low level voltage. Accordingly, the electric charges held in each node of the driving transistor 161 are discharged via the resistors 361 to 363. That is, in the present variation, the detection unit 10 and the panel control unit 220 as described in Embodiment 2 may be omitted.

In short, in the variation, the electric charge drawing unit that draws the electric charges held in each node of the driving transistor 161 provided in each of a plurality of pixels 260C when the power supply to the display device 2C is stopped corresponds to the resistors 361 to 363.

Here, it is desirable that the resistors 361 to 363 are resistors having a high resistance value that does not affect the light emission of the EL element 166 during a normal operation in which power is supplied to the display device 2C.

As described above, in the present variation, the electric charges held in each node of the driving transistor 161 are drawn by the resistors 361 to 363. With this configuration, the display device 2C according to the present variation has the same advantageous effects as those of Embodiments 1 and 2. That is, it is possible to suppress the degradation of the driving transistor 161 while the power supply to the display device 2C is stopped.

(Other Embodiments)

The embodiments and the variations have been described above as examples of the technique disclosed in the present application. However, the technique according to the present disclosure is not limited thereto, and is also applicable to embodiments obtained by making various modifications, replacements, additions, omissions, and the like as appropriate. It is also possible to make new embodiments by combining the structural elements described in the embodiments and the variations given above.

Hereinafter, other embodiments will be shown.

For example, in the description given above, it is stated that the electric charges held in each node of a driving transistor provided in each of a plurality of pixels are drawn when the power supply to the display device is stopped, but it is sufficient that at least the electric charges held in the gate of the driving transistor 161 are drawn.

Figure 18:
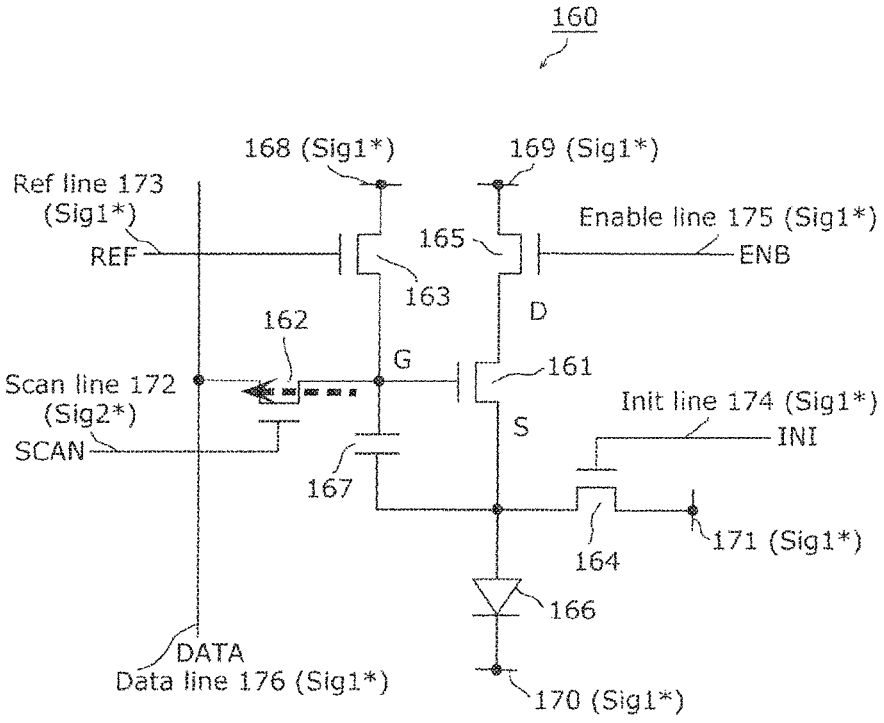
FIG. 18 is an illustrative diagram illustrating that electric charges are drawn from the gate of a driving transistor according to another variation of Embodiment 1.

To be specific, the display device 1 according to Embodiment 1 may draw electric charges as shown in FIG. 18. FIG. 18 is an illustrative diagram illustrating that electric charges are drawn from the gate of a driving transistor 161 according to another variation of Embodiment 1.

A pixel 160 shown in the diagram has the same configuration as that of Embodiment 1, except that the voltages corresponding to the panel control signal Sig1 are VINI, VREF, VTFT, VEL, DATA, a REF signal REF, an enable signal ENB, and an init signal INI, and the voltage corresponding to the panel control signal Sig2 is a scan signal SCAN. With this configuration, the electric charges held in the gate of the driving transistor 161 are drawn, but the electric charges held in the drain and the source of the driving transistor 161 are not drawn.

Figure 19:
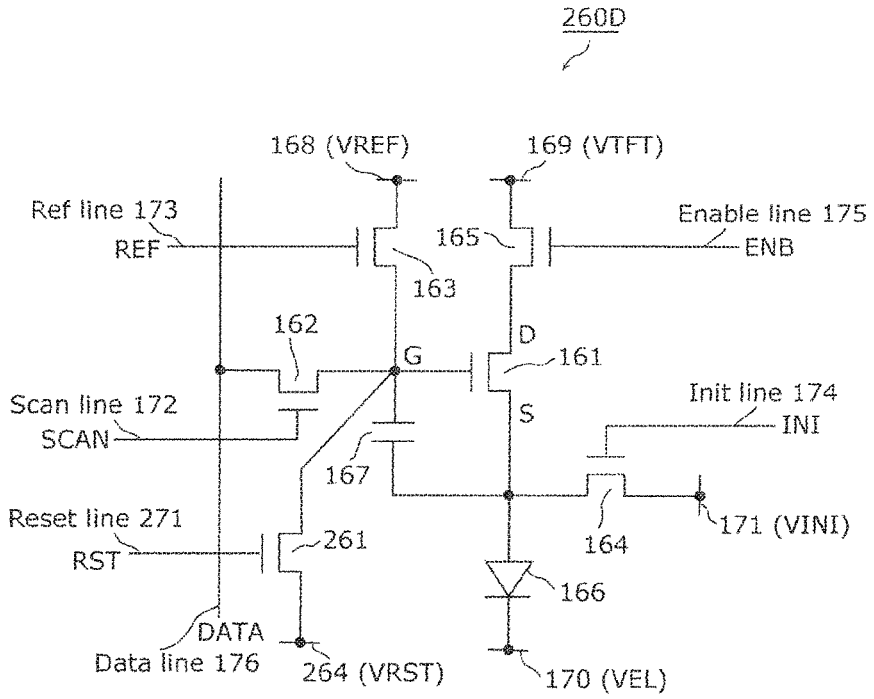
FIG. 19 is a circuit diagram showing a configuration of a pixel according to another variation of Embodiment 2.

Also, in Embodiment 2, each pixel may be configured as shown in FIG. 19. FIG. 19 is a circuit diagram showing a configuration of a pixel 260D according to another variation of Embodiment 2. In the pixel 260D configured as shown in the diagram, the electric charges held in the gate of the driving transistor 161 are drawn, but the electric charges held in the drain and the source of the driving transistor 161 are not drawn.

Figure 20:
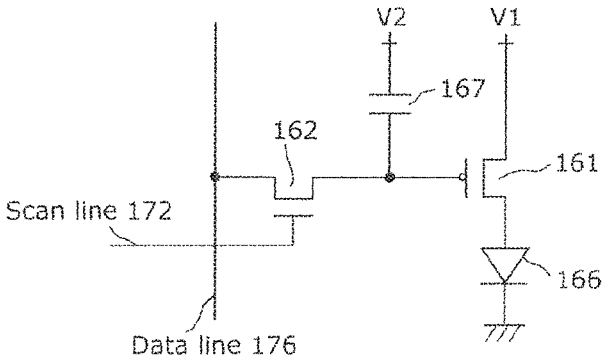
FIG. 20 is a circuit diagram showing a configuration of a pixel according to another embodiment.

Also, the pixel configuration is not limited to the configurations described above, and may be a configuration as shown in FIG. 20.

FIG. 20 is a circuit diagram showing a configuration of a pixel according to another embodiment. A pixel shown in FIG. 20 includes a driving transistor 161, a switch 162, an EL element 166, and a capacitor 167, and has a configuration simpler than that of the pixel shown in FIG. 3.

The driving transistor 161 shown in the diagram is a p-type TFT, rather than an n-type TEL and its drain is connected to a power supply line of a voltage V1.

One of the electrodes of the capacitor 167 is connected to a power supply line of a voltage V2. The voltage V1 may be the same as the voltage V2.

One of the source and the drain of the switch 162 is connected to the Data line 176, and the other of the source and the drain is connected to another electrode of the capacitor 167. The gate of the switch 162 is connected to the Scan line 172.

In a power supply stop operation performed in this configuration, if a stop of power supply is detected by the detection unit 10, the switch 162 (first switch) is placed in a conducting state after the voltage of the Data line 176 (first wiring line) reaches a low level voltage (for example, 0 [V]). With this configuration, it is possible to draw the electric charges held in the gate of the driving transistor 161. Accordingly, it is possible to suppress the degradation of the driving transistor 161 provided in each pixel while the power supply to the display device is stopped.

Also, the pixel configuration may be modified such that, for example, a switch is added between the power supply line of the voltage V1 and the driving transistor 161 in the circuit example shown in FIG. 20, and its gate is connected to the Enable line 175. A configuration is also possible in which a switch is added between the power supply line of the voltage V2 and the driving transistor 161 in the circuit example shown in FIG. 20, and its gate is connected to the Ref line 173. Also, a circuit configuration is also possible in which the initialization power supply line 171 is connected to the anode of the EL element 166 via a switch in the circuit example shown in FIG. 20, and the Init line 174 is connected to the gate of the switch.

Figure 2:
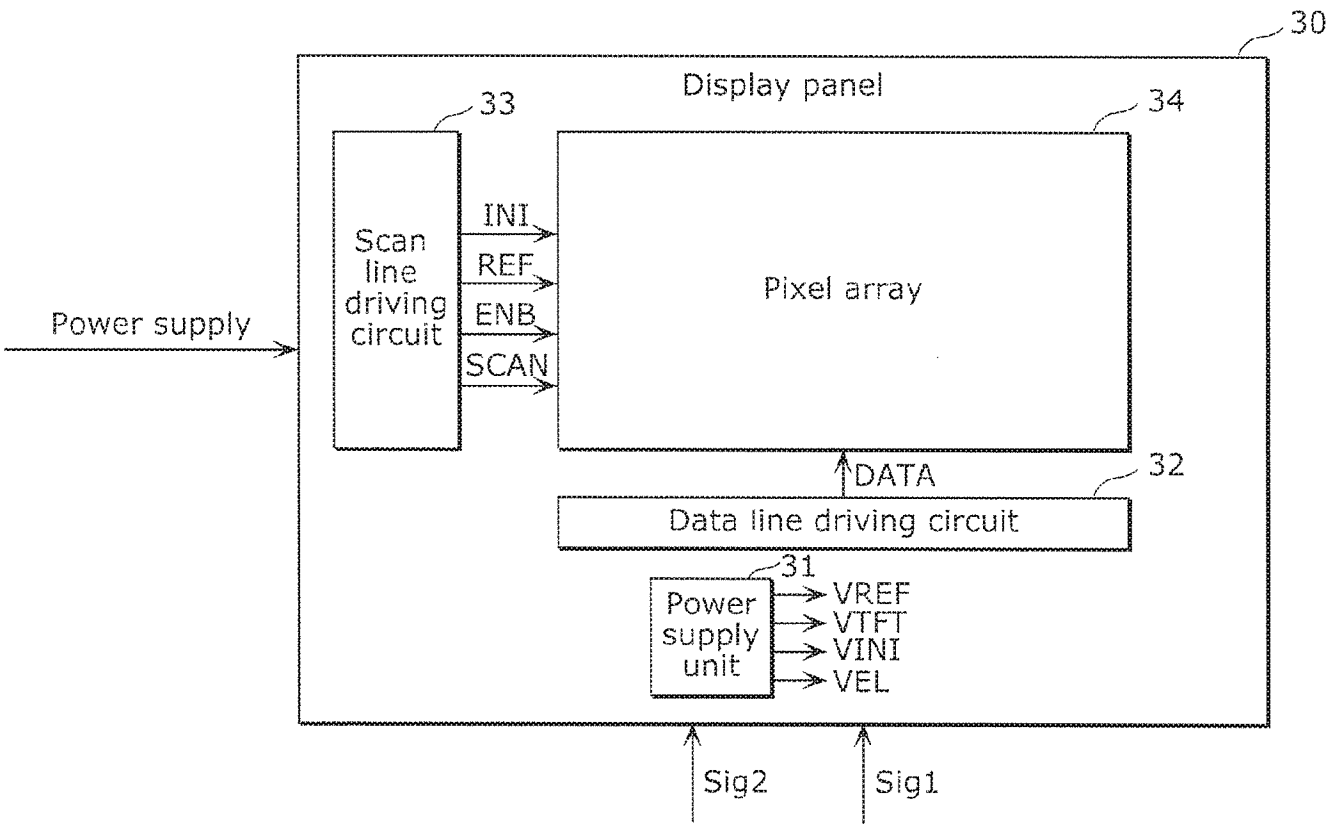
FIG. 2 is a block diagram showing an example of a configuration of a display panel shown in FIG. 1.

Also, the driving transistor 161 may be an n-type transistor as in FIG. 2, or may be a p-type transistor.

Also, at least one transistor of the switches 162 to 164 may be a p-type transistor. By configuring at least one transistor by using a p-type transistor as described above, when the power supply to the display device is stopped, the at least one transistor is placed in a conducting state by the signals output from the scan line driving circuit 33 (scan signal SCAN, REF signal REF, enable signal ENB, and init signal INI) being changed to a low level (for example, 0 V).

Accordingly, it is unnecessary to provide control and a configuration that, changes the signals output from the scan line driving circuit 33 to a low level when the power supply to the display device is stopped, and thus the control and configuration can be simplified.

Also, the present disclosure is not limited to the configuration in which the electric charges held in the gate of the driving transistor are drawn, and a configuration is also possible in which the electric charges held in the gate of another transistor (switching transistor) provided in each pixel are drawn. To be specific, it is possible to use a configuration in which when a switch provided in a pixel is placed in a non-conducting state as a result of the power supply being stopped, the electric charges held in a gate that is in a floating state in which the gate is not connected to any of the wiring lines are drawn. With this configuration, it is possible to suppress the degradation of the transistor including the gate while the power supply to the display device is stopped.

Also, the electric charges that are drawn are not limited to negative electric charges (electrons), and may be positive electric charges (holes).

Also, in Embodiment 2 described above, the switches 261 to 263 may be provided for each pixel 260A, or may be provided commonly for a plurality of pixels 260A.

Also, for example, there is no particular limitation on the material of the semiconductor layer used in the driving transistors and the switching transistors used in the light emitting pixels according to the present disclosure, but for example, an oxide semiconductor material such as IGZO (In—Ga—Zn—O) can be used. A transistor including a semiconductor layer made of an oxide semiconductor such as IGZO has less leakage current. Also, in the case where transistors including a semiconductor layer made of an oxide semiconductor such as IGZO are used as the switches, the threshold voltage can be set to a positive value, and thus the leakage current from the gate of the driving transistors can be suppressed.

Also, in the description given above, an organic EL element is used as the light emitting element, but any light emitting element can be used as long as it is a light emitting element whose light emission amount varies according to the electric current.

Figure 21:
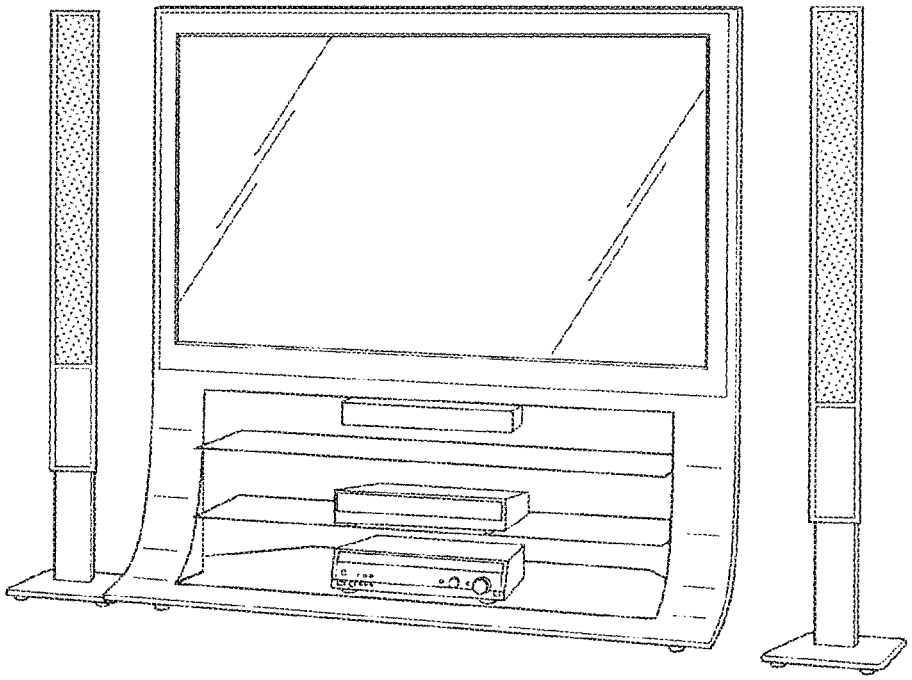
FIG. 21 is a diagram showing an external view of a flat panel display.

Also, the above-described display device such as an organic EL display device can be used as a flat panel display as shown in FIG. 21, and is also applicable to any electronic device having a display device such as a television set, a personal computer, and a mobile phone.

INDUSTRIAL APPLICABILITY

The present disclosure is applicable to a display device, and in particular to a display device such as a television set.

The invention claimed is:

1. A display device comprising:

a plurality of pixels arranged in a matrix, each of the plurality of pixels including:

a light emitting element that emits light according to an amount of current supplied;

a transistor that controls light emission of the light emitting element; and a first switch connected to a gate of the transistor;

an electric charge drawing unit configured to draw electric charges in the gate of the transistor included in each of the plurality of pixels when power supply to the display device is stopped; and a second switch connected to the gate of the transistor, wherein the electric charge drawing unit includes a detector configured to detect the stop of the power supply by detecting a reduction in a power supply voltage supplied from outside the display device, wherein the electric charge drawing unit is configured to draw the electric charges by placing the second switch in a conducting state when the stop of power supply is detected by the detector, wherein the first switch switches an electrical connection between the gate of the transistor and a first wiring line between a conducting state and a non-conducting state, the second switch switches an electrical connection between the gate of the transistor and a second wiring line different from the first wiring line between a conducting state and a non-conducting state, and a predetermined voltage is applied to the second wiring line.

2. The display device according to claim 1, wherein the electric charge drawing unit is configured to draw the electric charges by placing the first switch in a conducting state when the stop of power supply is detected by the detector.

3. The display device according to claim 1, wherein the electric charge drawing unit is configured to, when the stop of power supply is detected by the detector, place the first switch in a conducting state after a voltage of the first wiring line reaches a predetermined first wiring voltage.

4. The display device according to claim 3, wherein the first wiring line is a power supply line that supplies a power supply voltage for controlling the light emission of the light emitting element to the plurality of pixels or a signal line that supplies a signal voltage corresponding to a brightness level of the light emitting element to the plurality of pixels.

5. The display device according to claim 3, wherein the predetermined first wiring voltage is a voltage that reduces an electrical stress applied to the transistor.

6. The display device according to claim 1, wherein the transistor is a driving transistor that supplies an electric current to the light emitting element.

7. A display device comprising:

a plurality of pixels arranged in a matrix, each of the plurality of pixels including:

a light emitting element that emits light according to an amount of current supplied;

a transistor that controls light emission of the light emitting element;

a first switch that is connected to a gate of the transistor, and switches an electrical connection between the gate of the transistor and a first wiring line between a conducting state and a non-conducting state; and a second switch that is connected to the gate of the transistor, and switches an electrical connection between the gate of the transistor and a second wiring line between a conducting state and a non-conducting state, the second wiring being different from the first wiring line and to which a predetermined voltage is applied;

a detector configured to detect stop of power supply to the display device by detecting a reduction in a power supply voltage supplied from outside the display device; and a controller that draws electric charges in the gate of the transistor included in each of the plurality of pixels when the power supply to the display device is stopped, by placing the second switch in the conducting state when the stop of power supply is detected by the detector.

* * * * *